US008256880B2

(12) United States Patent
Coffey et al.

(10) Patent No.: US 8,256,880 B2
(45) **Date of Patent: *Sep. 4, 2012**

(54) FLUID HEIGHT BACKPRESSURE DEVICE IN A SYSTEM FOR SUPPLYING FLUID TO A PRINTHEAD

(75) Inventors: Johnnie Coffey, Winchester, KY (US); Steven Robert Komplin, Lexington, KY (US); Guion Yuvano Lucas, Lexington, KY (US); Randal Scott Williamson, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 481 days.

This patent is subject to a terminal disclaimer.

(21) Appl. No.: 12/504,757

(22) Filed: Jul. 17, 2009

(65) Prior Publication Data

US 2011/0012946 A1 Jan. 20, 2011

(51) Int. Cl.
*B41J 2/175* (2006.01)

(52) U.S. Cl. ..... 347/85; 347/92

(58) Field of Classification Search ..... 347/7, 84–85, 347/92

See application file for complete search history.

(56) References Cited

U.S. PATENT DOCUMENTS

| | | | | |
|---|---|---|---|---|
| 4,829,318 | A * | 5/1989 | Racicot et al. | 347/33 |
| 5,113,199 | A * | 5/1992 | Chan et al. | 347/87 |
| 5,583,554 | A * | 12/1996 | Masubuchi et al. | 347/171 |
| 5,757,406 | A * | 5/1998 | Kaplinsky et al. | 347/87 |
| 7,478,901 | B1 * | 1/2009 | Myers et al. | 347/86 |
| 2007/0229630 | A1 * | 10/2007 | Komplin | 347/87 |
| 2008/0024570 | A1 * | 1/2008 | Studer | 347/86 |

* cited by examiner

*Primary Examiner* — Julian Huffman
*Assistant Examiner* — Sharon A Polk

(57) ABSTRACT

A fluid height backpressure system includes a printhead, a fluid supply tank, a backpressure device, and an air removal device. The backpressure device responsible for supplying system backpressure includes at least one tower disposed in an upright position and having a plurality of walls defining first and second chambers for respectively communicating with the ink supply tank and a fluid supply reservoir of the printhead. The air removal device provides additional backpressure in the second chamber, allows backpressure in the system to be maintained even with an empty fluid supply tank, and also supply of ink to the fluid supply reservoir of the printhead substantially without air bubbles being introduced therein. Also, ink sensors are utilized for sensing different levels of ink in the ink supply tank and out-of-ink/ink-low conditions in the backpressure device and also to help establish and continue the operation of the backpressure device.

20 Claims, 15 Drawing Sheets

| | |
|---|---|
| □ | AIR REMOVAL DEVICE |
| • • | FLUID SENSORS |
| ↰ | NORMAL FLUID FLOW |

| | |
|---|---|
| ↓ | EXTRA BACKPRESSURE |
| ■□ | FLUID AND AIR |
| IN / OUT | INLET & OUTLET |

FLUID (INK)

FRONT

REAR

FLUID HEIGHT BACKPRESSURE DEVICE IN A SYSTEM FOR SUPPLYING FLUID TO A PRINTHEAD

BACKGROUND

1. Field of the Invention

The present invention relates generally to an off-carrier fluid supply system and more particularly, to a fluid height backpressure device in a system for supplying fluid to a printhead.

2. Description of the Related Art

Thermal inkjet printers apply ink to a print medium by ejecting small droplets of ink from an array of nozzles located in a printhead of a printhead cartridge. An array of thin-film resistors on an integrated circuit on the printhead selectively generates heat as current is passed through the resistors. The heat causes ink contained within an ink reservoir adjacent to the resistors to boil and be ejected from the array of nozzles associated with the resistor array A printer controller determines which resistors will be "fired" and the proper firing sequence so that the desired pattern of dots is printed on the medium to form an image.

Replacement printhead cartridges include integrated ink reservoirs. Due to weight limitations, these reservoirs usually contain much less ink than the printhead is capable of ejecting over its intrinsic lifetime. The useful lifetime of a printhead cartridge can be extended significantly if the integrated ink reservoir can be refilled. Several methods now exist for supplying additional ink to the printhead after the initial supply in the integrated reservoir has been depleted. Most of these methods involve continuous or intermittent siphoning or pumping of ink from a remote ink source to the print cartridge. The remote ink source is typically housed in a replacement ink tank which is "off-carrier," meaning it is not mounted on the carriage which moves the printhead cartridge across the print medium. In an off-carrier ink supply system, the ink usually travels from the remote ink tank to the printhead cartridge through a flexible conduit. It is desirable to maintain a backpressure in the off-carrier ink supply system to prevent drooling of ink from the printhead nozzles.

Most off-carrier ink supply systems use one of two general methods to accomplish the required backpressure. Some use an onboard pressure regulation system. These have been configured to use either an intermittent refill system (periodic ink re-supply) or a generally pressurized continuous ink supply that re-supplies ink to the printbead when a valve is opened. The other type of system is passive and uses the off-carrier fluid height to supply the proper backpressure (negative pressure) to the printhead. The second type of system may use a vented intermediate tank.

Pressure regulation systems are generally independent of the supply height and have greater flexibility in supply location. The second type of system is simpler, but must have the ink supply or an intermediate ink tank at a particular height below the printhead. The limited supply location is a drawback with this type of system and becomes more of a problem as a user prefers smaller and smaller machines. Although backpressure can be added by use of spring loaded diaphragms, this tends to add complexity and cost.

Consequently there is a need for an innovation in a fluid height backpressure system for supplying fluid to a printhead that addresses the location issue without adding complexity to the supply.

SUMMARY OF THE INVENTION

The present invention provides an innovation in the form of a fluid height backpressure system that increases system backpressure so as to eliminate the importance of location for proper printer performance to be maintained. To achieve this, the fluid height backpressure system employs a backpressure device having a device body and a pair of closures. The device body and closures are assembled together to construct at least one and preferably a plurality of towers positioned side-by-side one another and each having a set of first and second chambers. Further, the system utilizes a plurality of different structural elements that are formed on opposite sides of the device body to perform different functions or serve different purposes.

Accordingly, in an aspect of the present invention, a fluid height backpressure device includes a device body, a pair of closures, continuous exterior edge walls, interior partition walls, an inlet, and an outlet. The device body of substantially planar configuration has opposite sides. The closures are of substantially planar configuration. Each closure is positioned on one of the opposite sides of the device body, the closures and device body being assembled into at least one tower as a single unit of a substantially planar configuration and having a perimeter and first and second chambers within the perimeter. The device body provides an intermediate wall of the tower, and the closures provide opposite end walls of the tower facing toward each other. The continuous exterior edge walls are formed on and protrude outwardly from the opposite sides of the device body and are located between the device body and closures so as to define the perimeter of the tower. The interior partition walls are encompassed by the continuous exterior edge walls, formed on and protruding outwardly from the opposite sides of the device body, and located between the device body and closures so as to define the first and second chambers within the perimeter of the tower. The closures are fixedly attached to outer surfaces on the continuous exterior edge walls and the interior partition walls so as to enclose the first and second chambers of the tower. Further, the inlet is formed through the device body to permit flow of fluid into the first chamber while the outlet is formed through the device body to permit the flow of fluid from the second chamber. Also, a fluid drip port is located between the first and second chambers for establishing backpressure in the second chamber of the tower.

In a further aspect of the present invention, a fluid height backpressure system for supplying fluid from a fluid supply tank to a printhead includes a backpressure device disposed in an upright position and having a tower with a plurality of walls spaced apart from one another so as to define first and second cha bers, the second chamber containing fluid and air making contact with the fluid at an air-fluid interface such that an air gap is created in the second chamber between the first chamber and the air-fluid interface in the second chamber, the first and second chambers connected in flow communication with each other by a drip port of the first chamber that opens into the second chamber such that fluid can drop downward from the drip port through the air gap to the fluid in the second chamber. The system also includes an inlet on the first chamber of the backpressure device for coupling with a fluid supply tank vented to external atmosphere for enabling flow of fluid from the fluid supply tank to the first chamber of the backpressure device, and an outlet on the second chamber of the backpressure device for coupling with a printhead for enabling flow of fluid from the second chamber of the backpressure device to the printhead. The system further includes an upright passageway defined in the first chamber in communication with the inlet for receiving fluid from the fluid supply tank, the upright passageway also in communication with the backpressure-containing portion of the second chamber such that fluid from the upright passageway communicates through the drip port of the first chamber and drops downward through the air gap of the second chamber to reach the fluid therein. The system still further includes an upright column portion defined in the first chamber separate from the upright passageway and in communication with the inlet for receiving fluid from the fluid supply tank, the upright column portion being vented to the exterior atmosphere at a location above an upper level of the fluid therein so as to be isolated from the upright passageway while permitting the upper level of the fluid to equalize height with an upper level of fluid in the fluid supply tank. The system also includes at least one fluid sensor on the back pressure device being connected with the upright column portion of the first chamber thereof to enable providing an indication of the level of the fluid in the upright column portion relative to the at least one fluid sensor and thereby providing a corresponding indication of the level of the fluid in the fluid supply tank

BRIEF DESCRIPTION OF THE DRAWINGS

Figure 1:
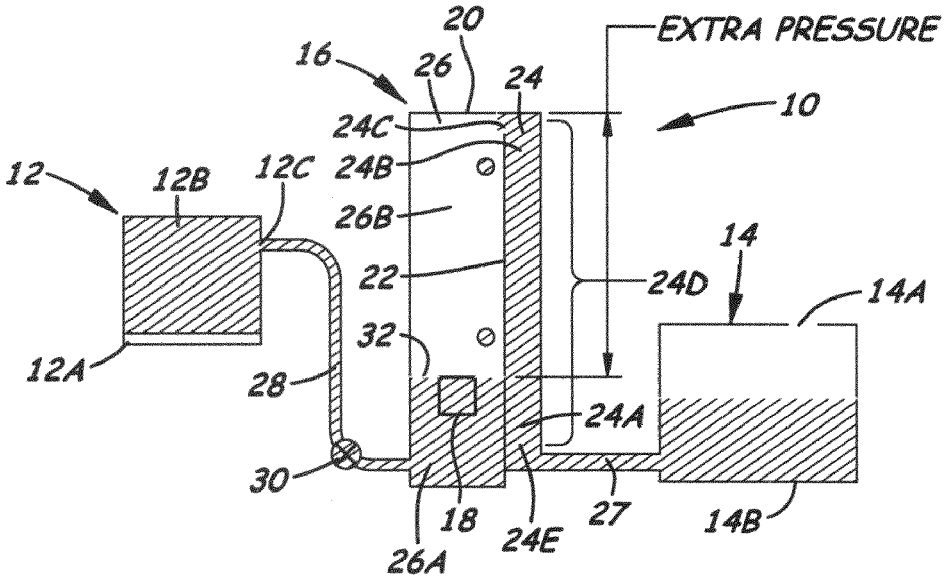

Having thus described the invention in general terms, reference will now be made to the accompanying drawings, which are not necessarily drawn to scale, and wherein:

FIG. 1 is a diagram of a fluid height backpressure system with a backpressure device.

Figure 2:
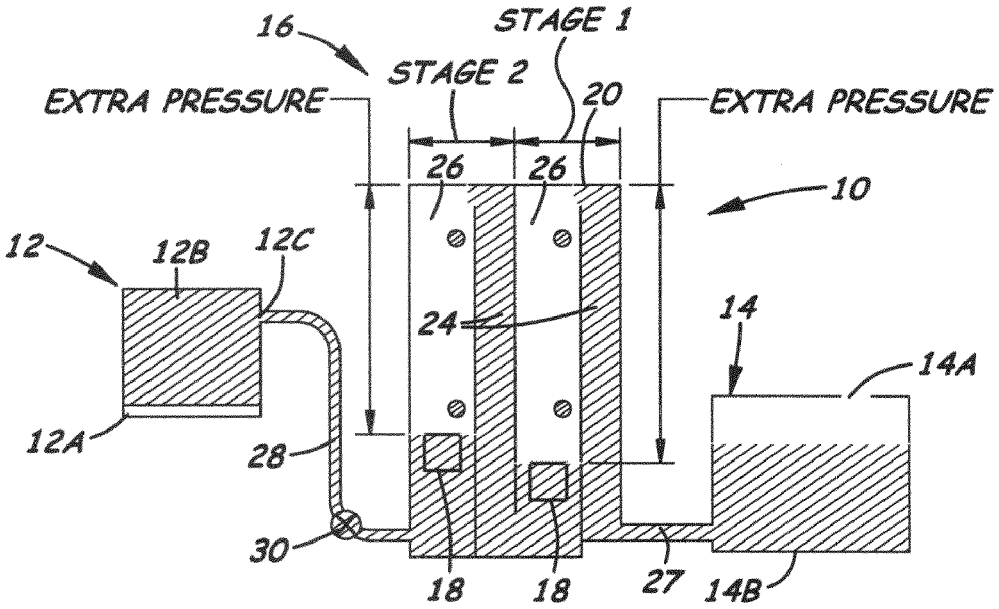

FIG. 2 is a diagram of the system of FIG. 1 having a dual stage backpressure device.

Figure 3A:
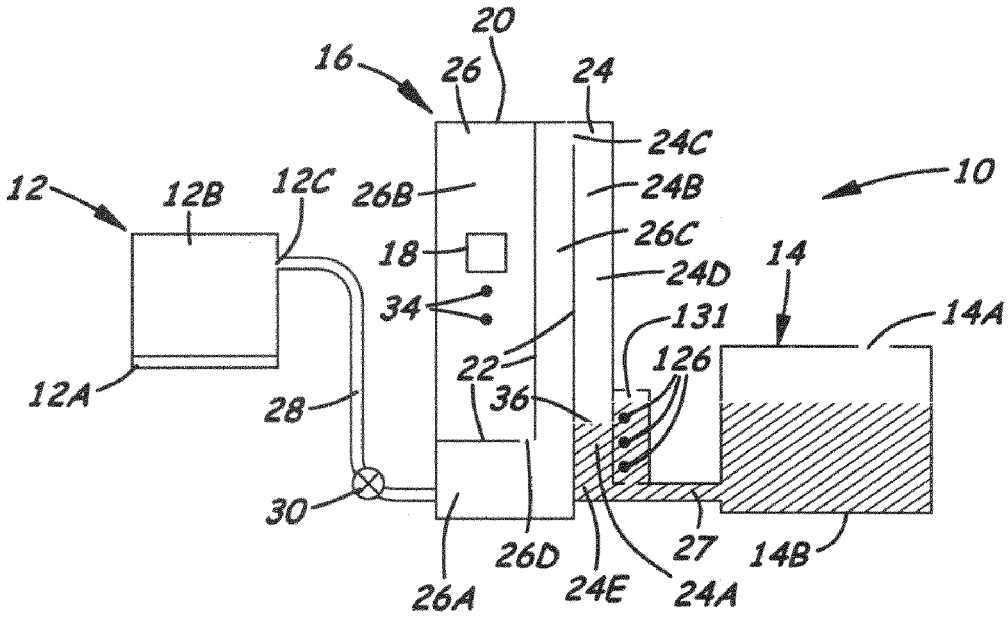

FIG. 3A is diagram of the system after initial supply tank installation and prior to start of priming with fluid by air removal from the backpressure device and also showing fluid sensors for sensing different levels of fluid in the supply tank.

Figure 3B:
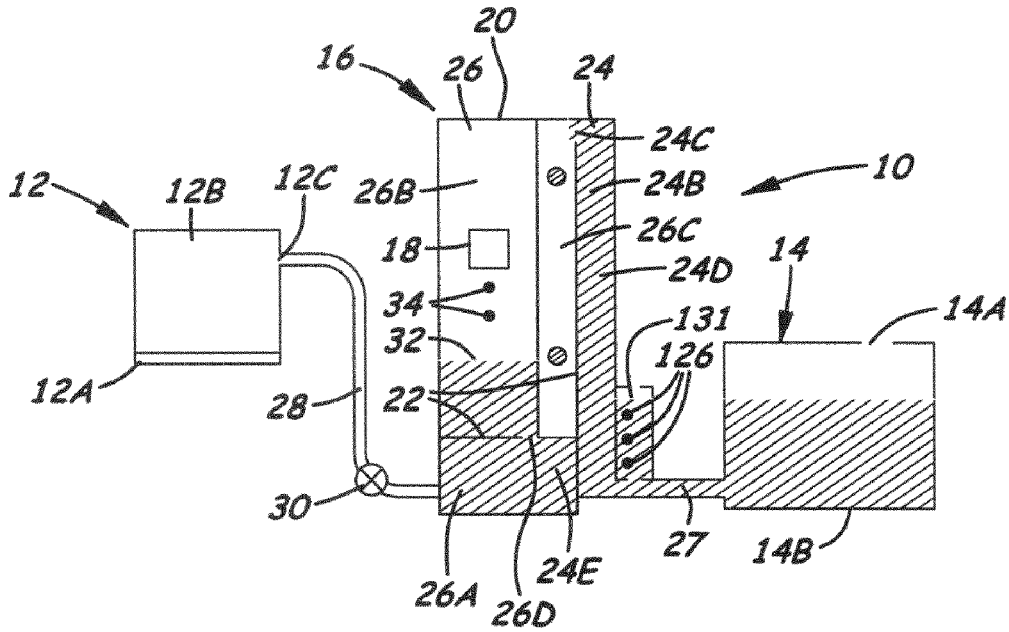

FIG. 3B is a diagram of the system during priming with fluid by air removal from the backpressure device.

Figure 3C:
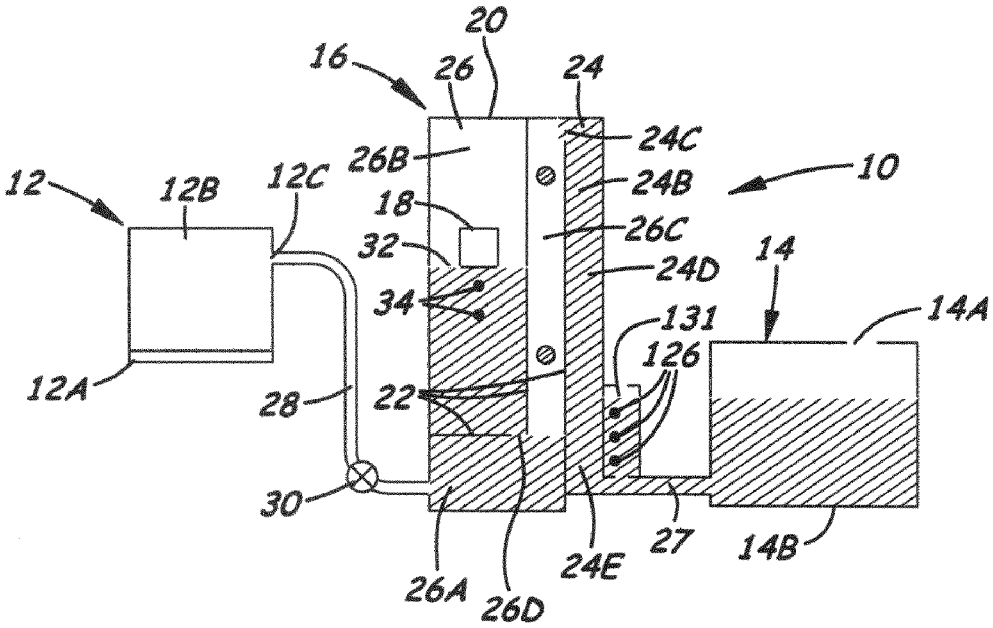

FIG. 3C is a diagram of the system upon sensing the air-fluid interface at which air removal from the backpressure device and fluid filling of the backpressure device may be stopped.

Figure 3D:
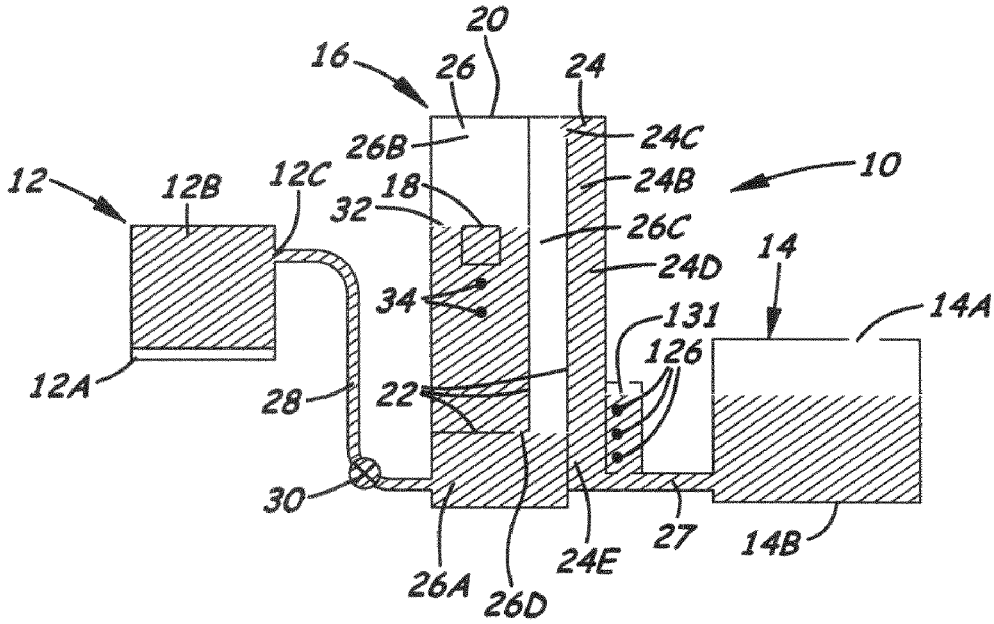

FIG. 3D is a diagram of the system at completion of the maximum air removal and fluid filling operations of the backpressure device.

Figures 4, 5:
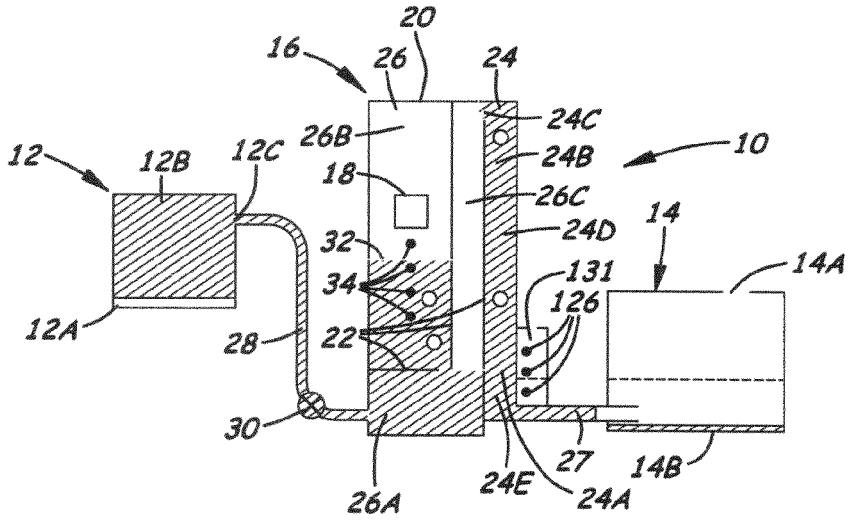

FIG. 4 is a diagram of the system showing operation of the system in sensing the air-fluid interface at a low or out-of-fluid condition of the system.

Figure 6:
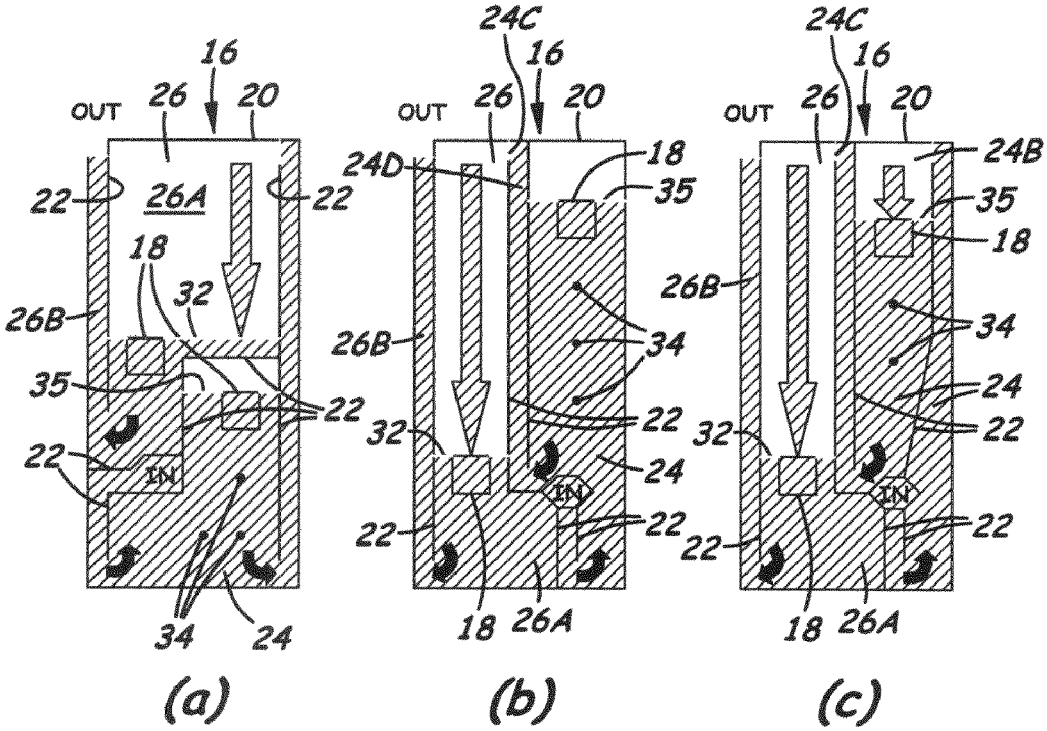

FIG. 5 is a key for symbols used in FIGS. 1-4, 6, 7, 18 and 19 of exemplary embodiments of backpressure devices of the system, FIG. 6 is a series of diagrams of exemplary embodiments of backpressure devices of the system with two air removal devices.

Figure 7:
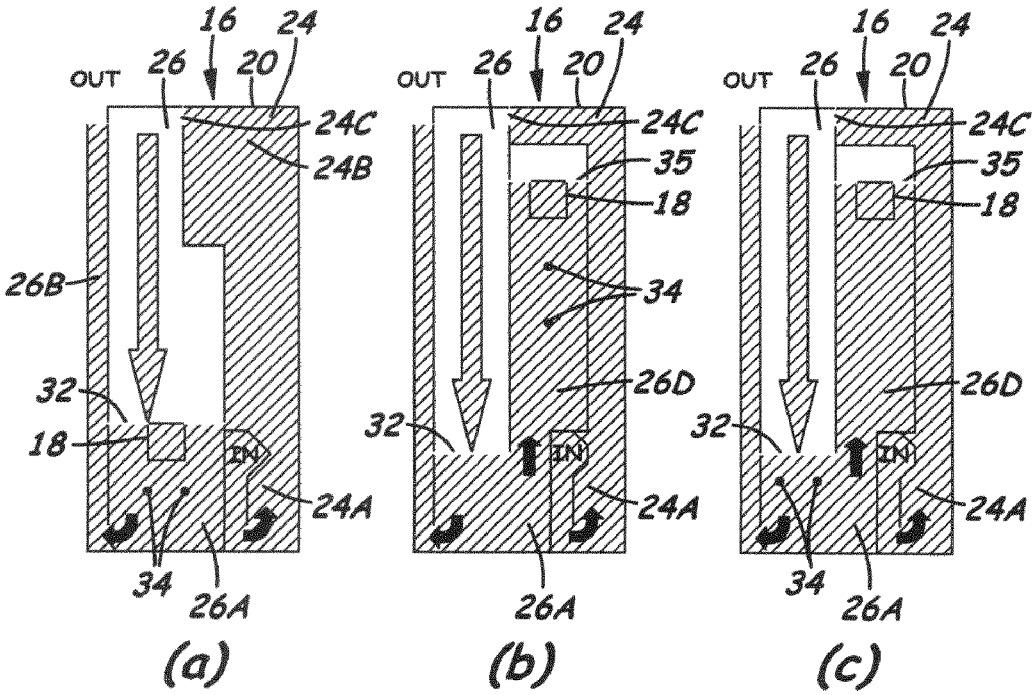

FIG. 7 is a series of diagrams of exemplary embodiments of backpressure devices of the system with a single air removal device.

Figure 8:
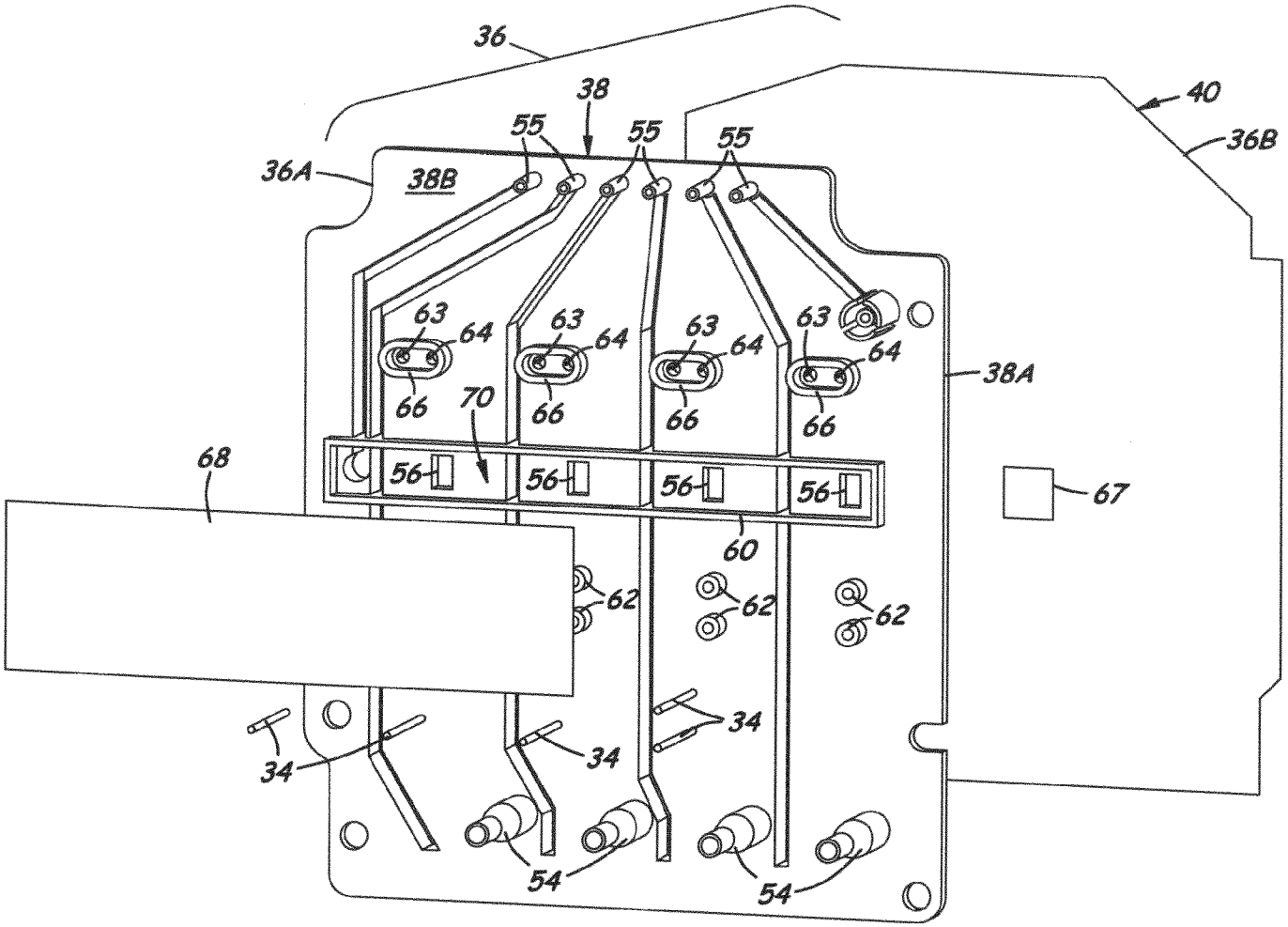

FIG. 8 is an exploded front perspective view of another exemplary embodiment of a fluid height backpressure device.

Figure 9:
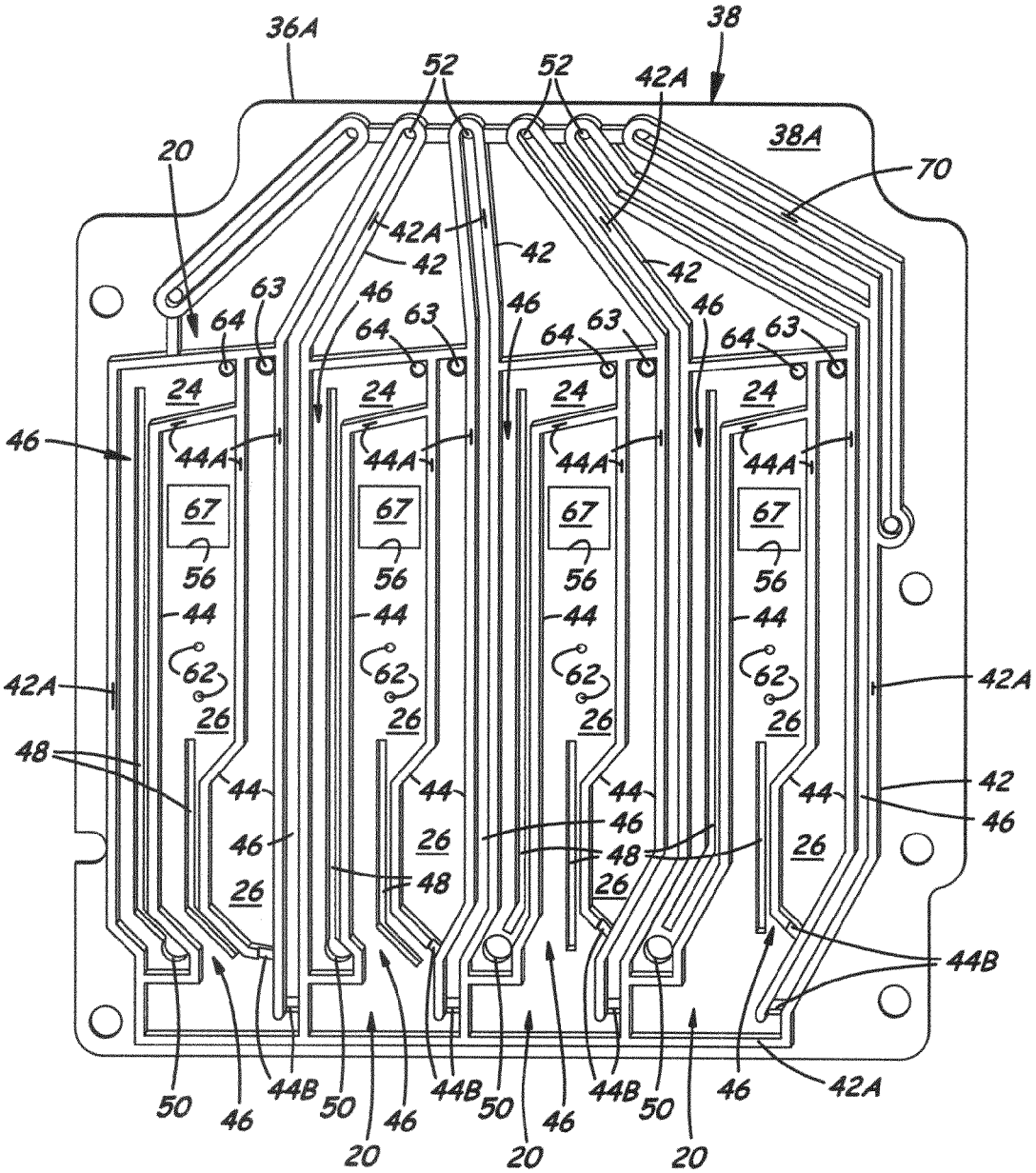

FIG. 9 is a rear perspective view of a device body of the backpressure device of FIG. 8.

Figure 10:
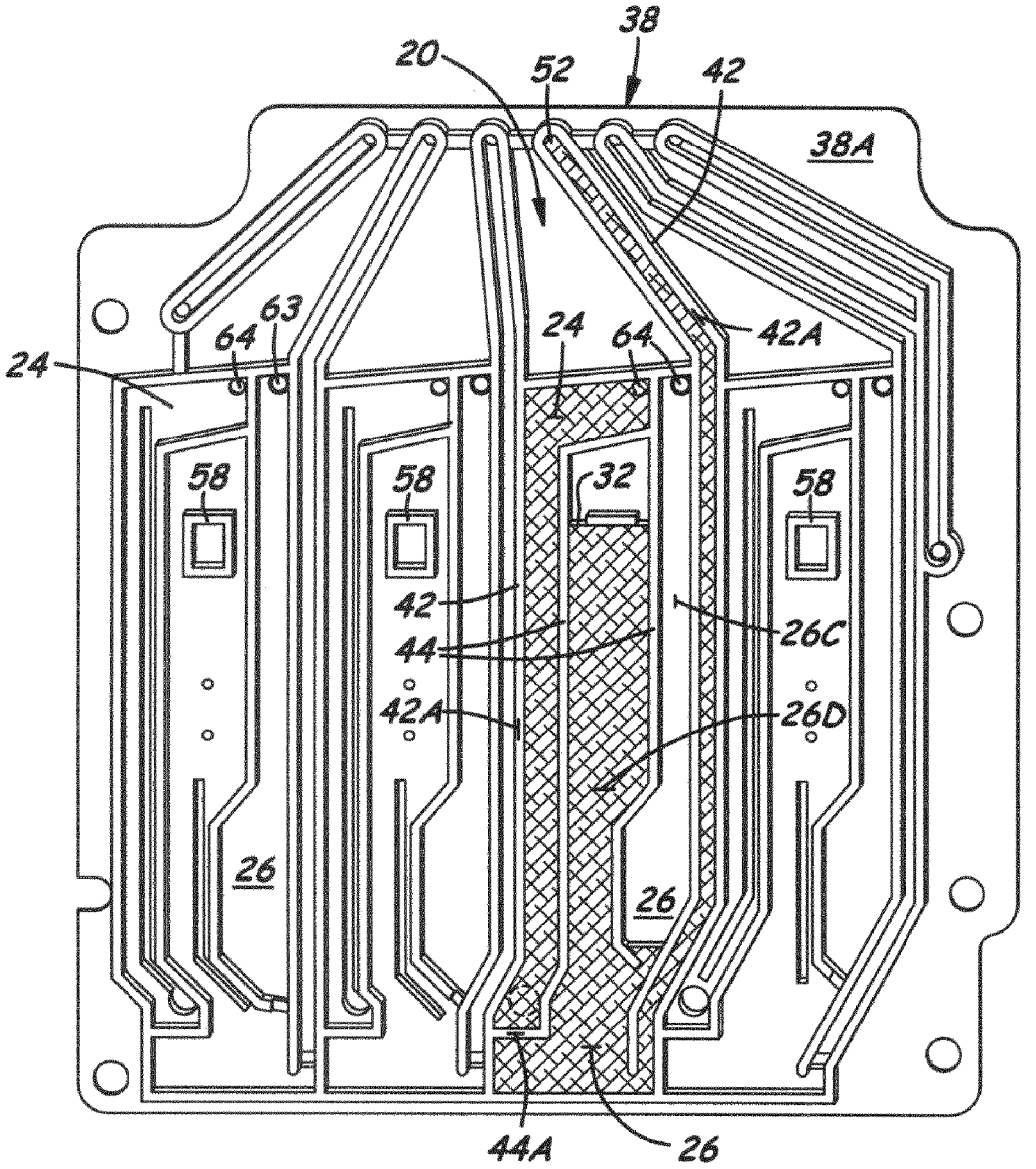

FIG. 10 is a rear perspective view of the device body similar to that of FIG. 9 but now showing one of the towers having fluid therein.

Figure 11:
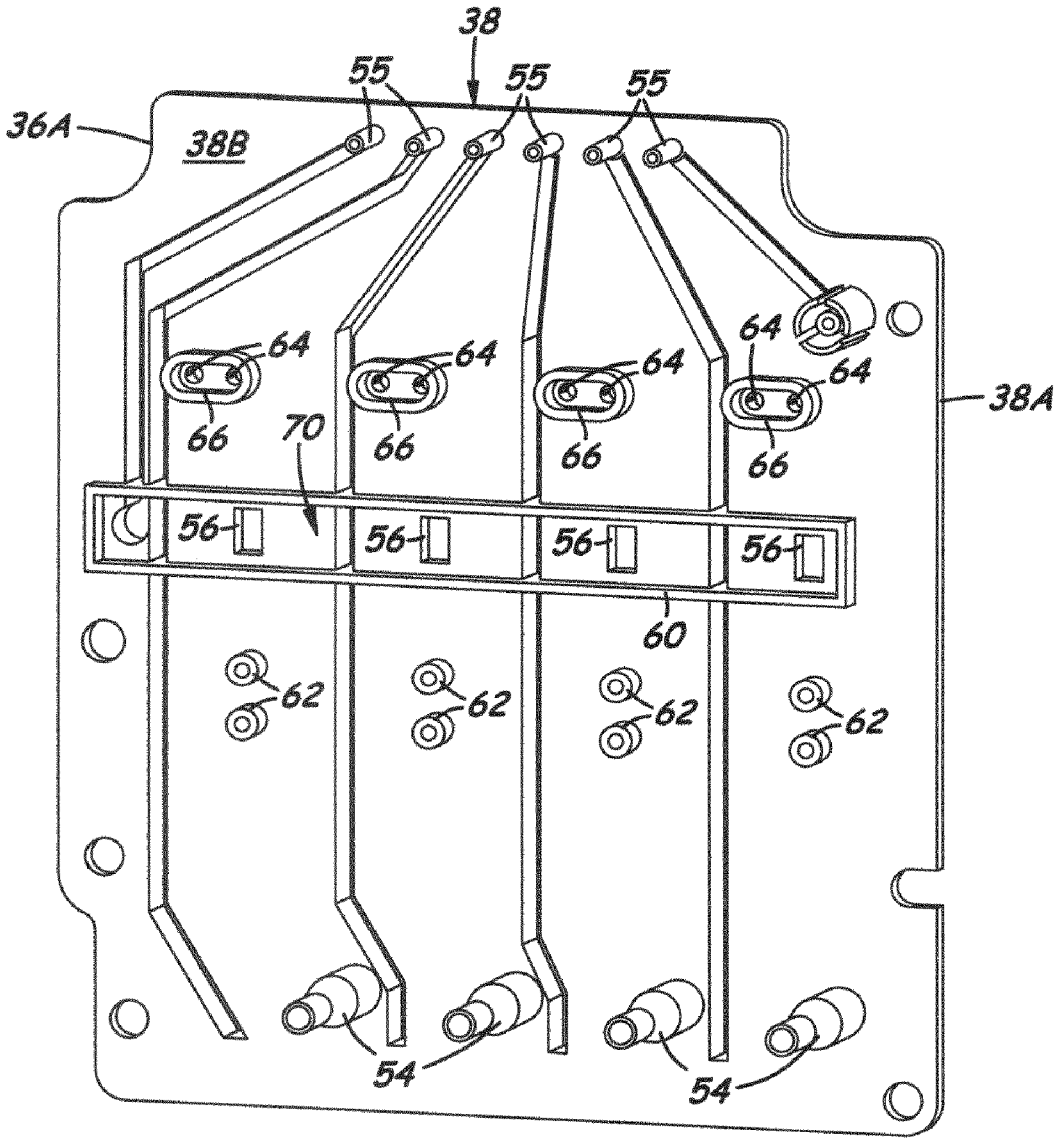

FIG. 11 is a front perspective view similar to that of FIG. 8 but now showing the device body alone.

Figure 12:
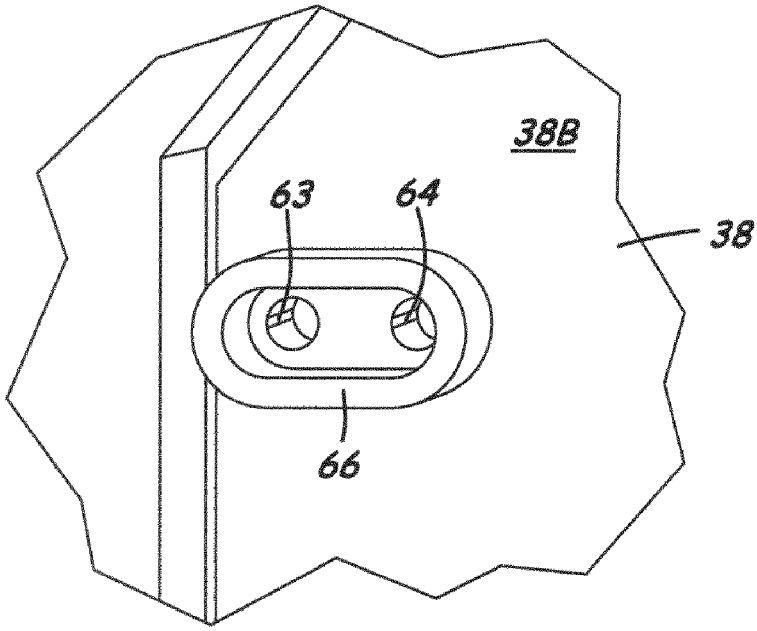

FIG. 12 is an enlarged fragmentary front perspective view of one of the by-pass channels on the device body shown in FIGS. 8 and 11 provided for interconnecting one of the pairs of the fluid entrance and drip ports.

Figure 13:
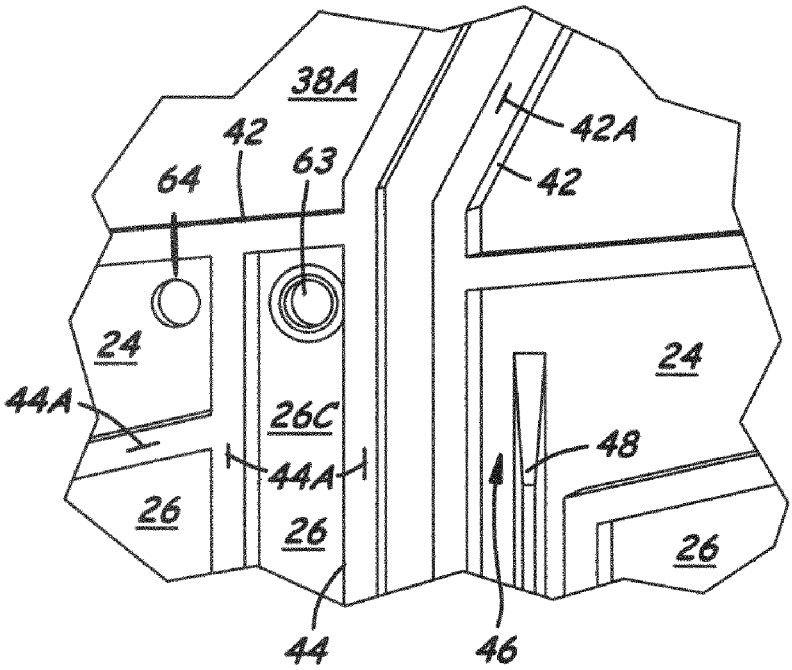

FIG. 13 is an enlarged fragmentary front perspective view of one of the pairs of the fluid entrance and drip ports for establishing additional backpressure in the system.

Figure 14:
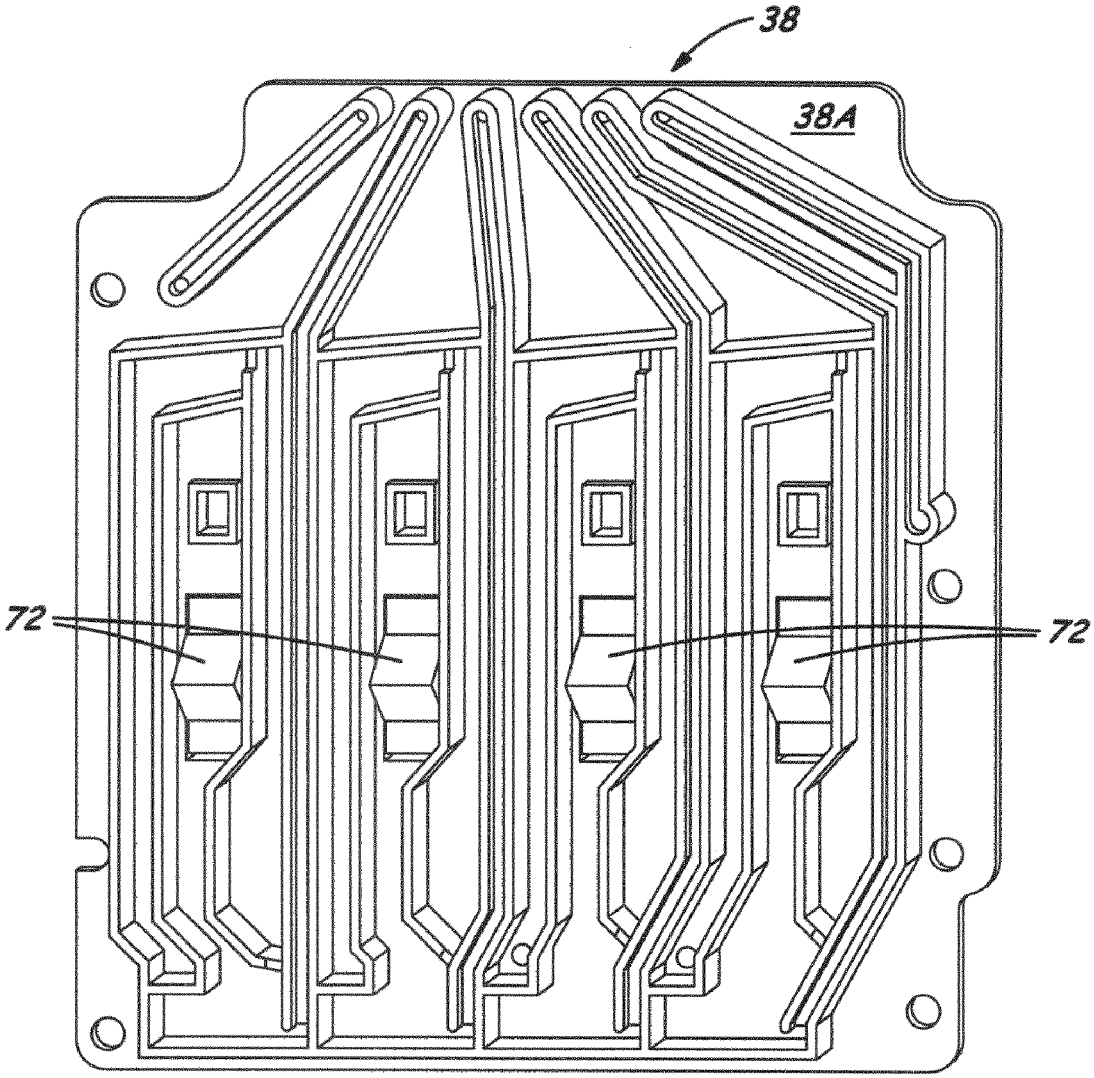

FIG. 14 is a front perspective view similar to that of FIG. 11 but showing an alternative embodiment of device body for the backpressure device.

Figure 15:
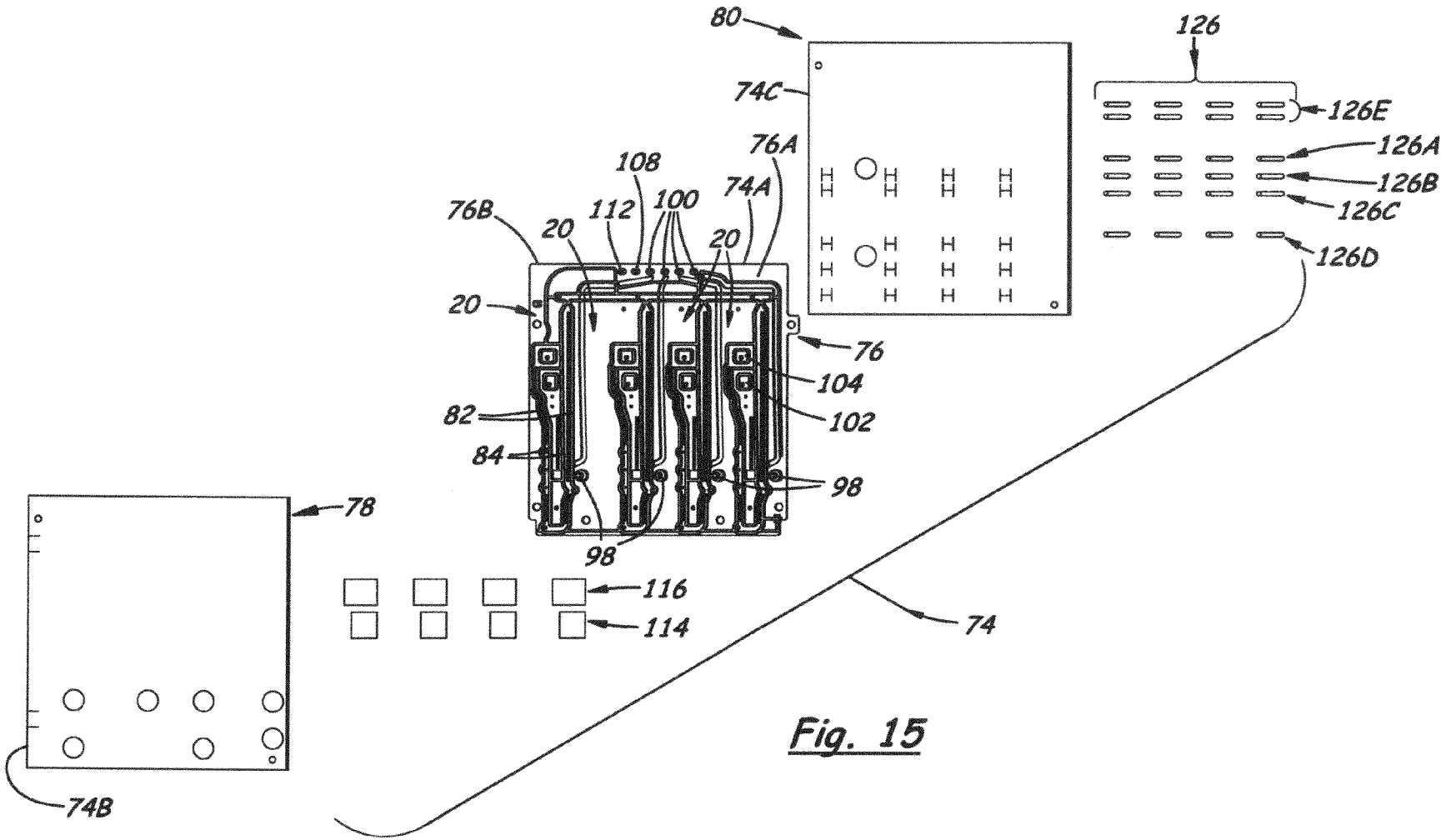

FIG. 15 is an exploded front perspective view of still another exemplary embodiment of a fluid height backpressure device.

Figure 16:
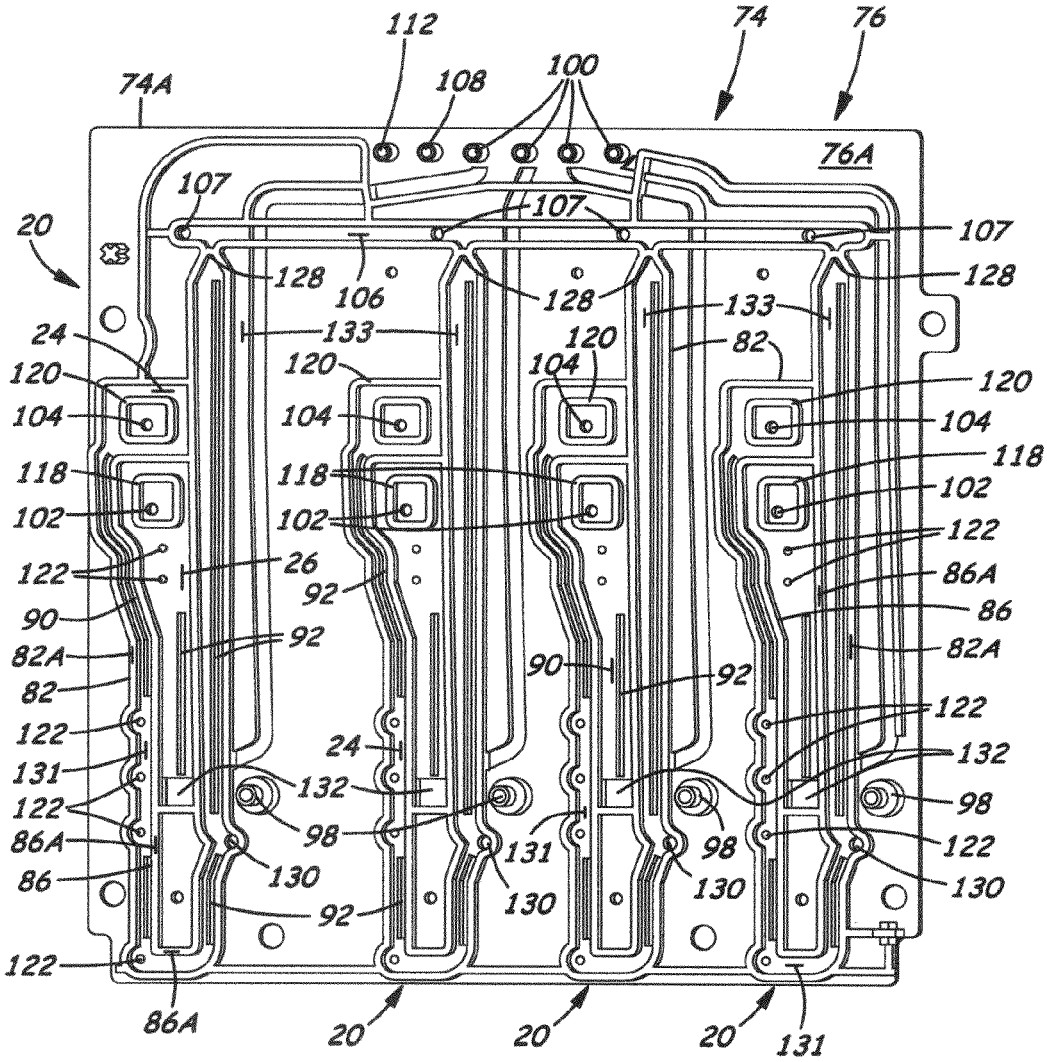

FIG. 16 is a front perspective view of a device body of the backpressure device as seen along lines 1 16 of FIG. 15.

Figure 17:
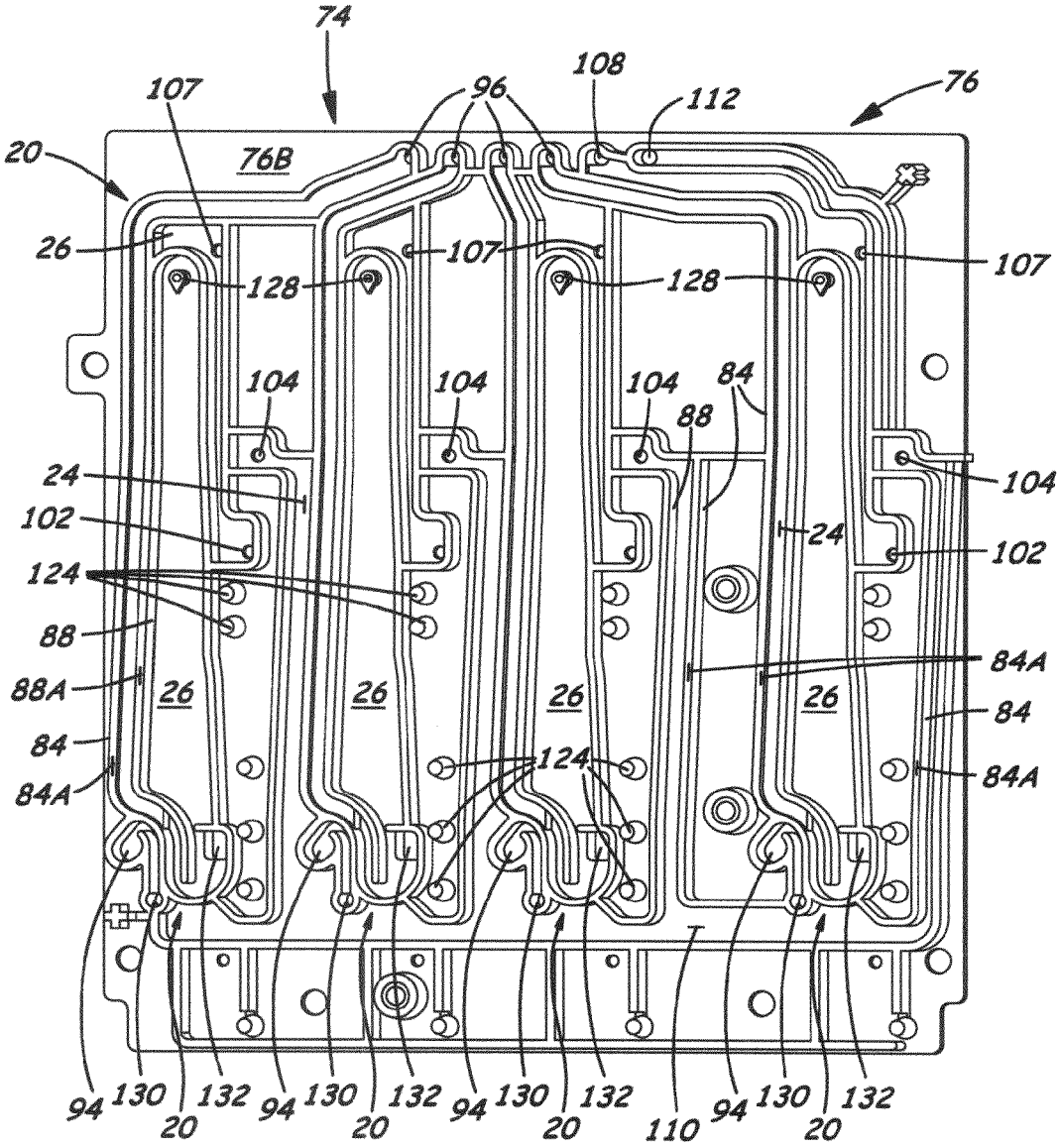

FIG. 17 is a rear perspective view of the device body of the backpressure device of FIGS. 15 and 16.

Figure 18:
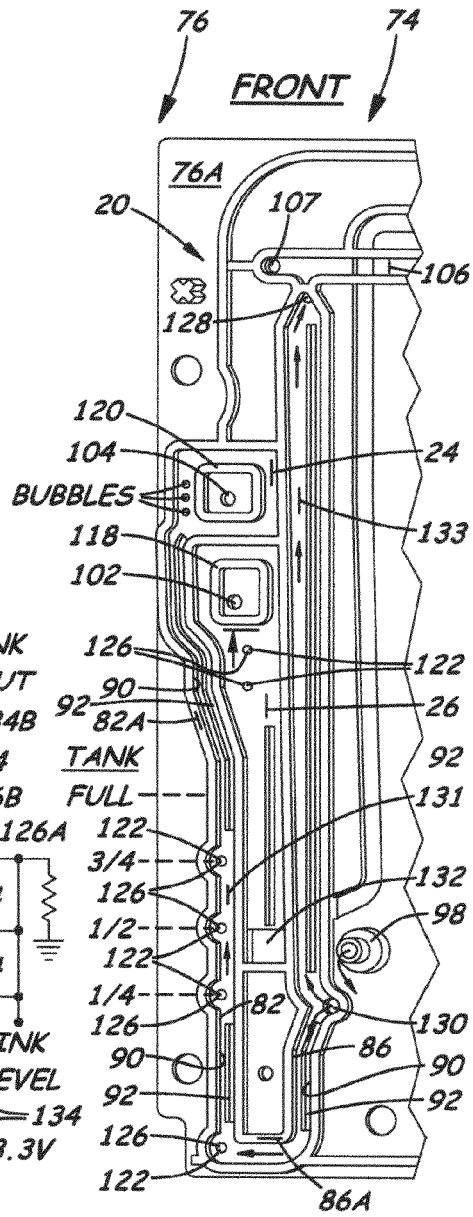

FIG. 18 is an enlarged fragmentary view of the front left end portion of the device body of FIG. 16.

Figure 19:
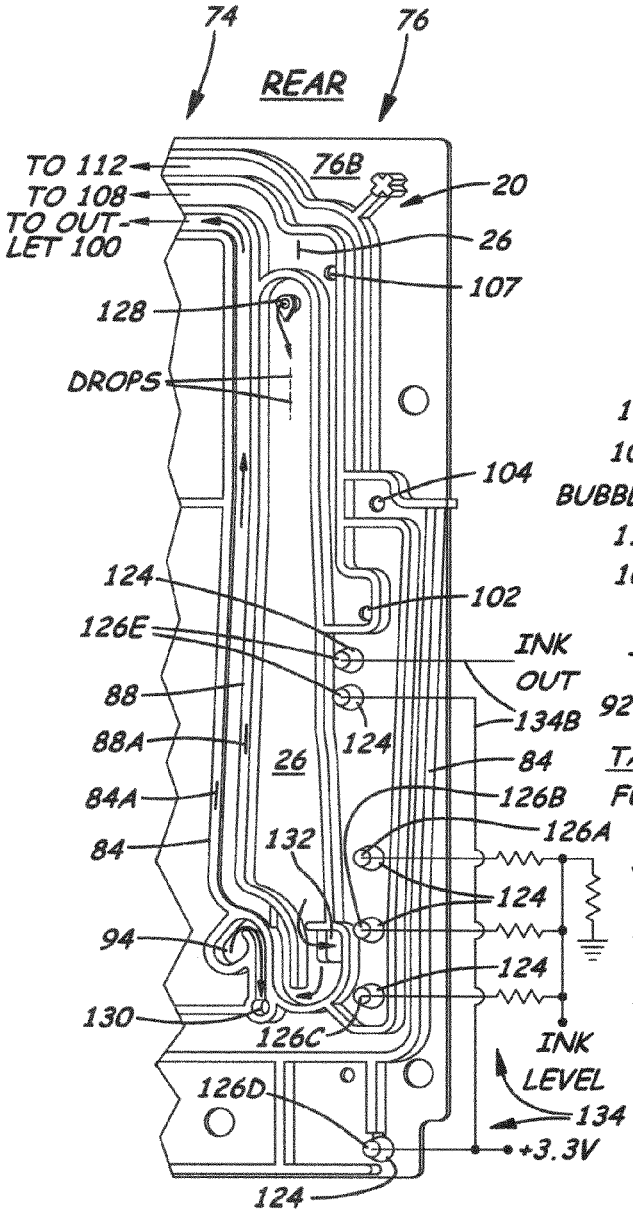

FIG. 19 is an enlarged fragmentary perspective view of the right end portion of the device body of FIG. 17 which is at the backside of the fragmentary portion of the device body of FIG. 18.

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views. The term "fluid" as used hereinafter is limited to liquids and not intended to cover gases, such as air.

Referring now to FIGS. 1 and 2, there is diagrammatically illustrated exemplary embodiments of a fluid height backpressure system, generally designated 10. The system 10 basically includes a printhead 12, a fluid supply tank 14, the backpressure device 16, and an air removal device 18. The printhead 12 employed by the fluid height backpressure system 10 has a bottom nozzle 12A with orifices (not shown) for ejection of fluid therefrom. Disposed above the nozzle 12A of the printhead 12 is a fluid reservoir 12B to supply fluid to the nozzle orifices. The fluid supply tank 14 contains a quantity of fluid for re-supplying the fluid reservoir 12B of the printhead 12 via the backpressure device 16. The fluid supply tank 14 may have an air vent 14A that introduces atmospheric air pressure into the fluid supply tank 14 above the surface of the quantity of fluid therein.

The backpressure device 16 responsible for supplying backpressure for the system 10 is disposed in an upright position between the printhead 12 and fluid supply tank 14. The backpressure device 16 may be provided in the form of a tower 20 having a plurality of interior walls 22, as best seen in FIGS. 3A-3D, 4, 6 and 7, spaced apart from one another so as to define first and second chambers 24, 26. The first chamber 24 located on the tank side of the device 16 is basically for communicating with the ink supply tank 14. The second chamber 26 located on the printhead side of the device 16 is basically for communicating with the printhead 12. The second chamber 26 is partially filled with both air and ink and communicates with the fluid reservoir 12B to supply it with ink. The first chamber 24 creates a column of fluid to help establish and maintain an air drop height in the second chamber 26. A first conduit 27 interconnects a lower end 14B of the fluid supply tank 14 in flow communication with a lower portion 24A of the first chamber 24. A second conduit 28 interconnects a lower portion 26A of the second chamber 26 in flow communication with an upper inlet 12C of the fluid reservoir 12B of the printhead 12. A printhead connection valve 30 may be incorporated into the second conduit 28 and used to help prime the system 10. The valve 30 also is open while printing and can be closed when not printing.

To provide the backpressure device 16, it is preferred to use chambers instead of tubing in order for either one of additional backpressure or reserve ink to be maintained. Chambers must be properly sized or shaped to allow the fluid to drop past (or downward through) air in an upper portion 26B of the second chamber 26 and for air to rise past (or upward through) the fluid in the lower and upper portions 24A, 24B of the first chamber 24 without acting like tubing If air starts to bubble into the first chamber 24, the air will rise and then be transferred to the second chamber 26. The height in the first chamber 24 will only be reduced slightly while the fluid in the second chamber 26 will decrease and lower the fluid height in the second chamber 26. This can occur during an out-of-fluid condition with the fluid supply tank 14.

As shown in the diagrams of FIG. 6, the first and second chambers 24, 26 can be positioned in one of the two arrangements. In the first arrangement shown in diagram (a), the second chamber 26 is positioned above the first chamber 24 with an upper outlet 24C from the upper portion 24B of the first chamber 24 opening into the upper portion 26B of the second chamber 26. In the second arrangement shown in diagrams (b) and (c), the first chamber 24 and the second chamber 26 are positioned side-by-side one another with the upper outlet 24C of the upper portion 24B of first chamber 24 opening into the upper portion 26B of the second chamber 26 A benefit of using the second arrangement is the greater amount of backpressure being generated in a given width.

More particularly, in the first arrangement the plurality of interior walls 22 provide the second chamber 26 in the position substantially above the first chamber 24. In the second arrangement the plurality of interior walls 22 provide the first and second chambers 24, 26 in positions substantially side-by-side with one another. However, in both the upper portion 24B of the first chamber 24 via its outlet 24C is interconnected in flow communication with the upper portion 26B of the second chamber 26. The plurality of interior walls 22 further provide an upright passageway 24D in the upper portion 24B of the first chamber 24 interconnecting its lower portion 24A via its outlet 24C with the upper portion 26B of the second chamber 26 such that fluid from the top of the column thereof in the upright passageway 24D drops downward from the outlet 24C through the upper portion 26B of the second chamber 26 to reach the fluid in the lower portion 26A thereof Referring again to FIGS. 1 and 2, the air removal device 18 of the system 10 establishes the backpressure in the second chamber 26 of the backpressure device 16. To accomplish this function, the air removal device 18 preferably is disposed in communication with the second chamber 26 of the device 10 near an air-fluid interface 32 therein and upstream from the second conduit 28. The air removal device 18 is operable to enable periodically removing some air and also potentially fluid from the upper portion 26B of the second chamber 26. This periodic removing of some air maintains the additional backpressure of the system 10 therein for drawing fluid from the first chamber 24 into the second chamber 26 and supplying fluid from the lower portion 26A of the second chamber 26 to the fluid reservoir 12B.

Additionally, the air removal device 18 allows the backpressure in the system 10 to be maintained even with an empty fluid supply tank 14 and also so that fluid is supplied to the fluid supply reservoir 12B substantially without air bubbles being introduced there. This prevention of air bubbles being introduced is accomplished by keeping the fluid inlet of tube 28 from the second chamber 26 below the level of the air-fluid interface 32 in the second chamber 26 and removing excess air from the second chamber 26 via the air removal device 18.

The air removal device 18 may take the form of any suitable means as long as there is an establishment of the initial proper conditions and/or the maintenance of the proper conditions during the life of the printer (not shown). One suitable air removal device 18 may include a valve (not shown) with one side operationally connected to a source of vacuum such as a pump (not shown) and operated under printer control or with a float type system (not shown) with an automatic shut-off seal (not shown). Alternatively, the air removal device 18 may include a hydrophobic membrane (as shown in the embodiments of FIGS. 8 and 15) and can pull air out of the system without removing fluid. Both of these alternative forms of the air removal device 18 can remove air subsequent to an initial priming operation.

The first embodiment of the fluid height backpressure system 10, as seen in FIG. 1, employs a backpressure device 16 that is a single stage unit formed by singular ones of the first and second chambers 24, 26. An additional feature of the backpressure device 16 of the system 10, as seen in the second embodiment of FIG. 2, is its ability to be a dual stage unit formed by side-by-side pairs of the first and second chambers 24, 26. Having dual stages in the backpressure device 16 allows for multiple pressure drops with the option of adding additional units in series to increase the backpressure. Using an increased backpressure device can help lower the overall printer height, allow for larger capacity tanks which are height limited, or allow tanks to be positioned wherever required in a printer. Tanks can even be located above the printhead 12, while still maintaining proper printhead backpressure. One advantage with this type of increased backpressure system is that fluid can flow back towards the fluid supply tanks 14 during air expansion event that may occur at the printhead 12.

Turning now to FIGS. 3A to 3D, in another exemplary embodiment the fluid height backpressure system 10 further includes at least one and preferably multiple fluid sensors 34 associated with at least the partitioned upper portion 26B of the second chamber 26 for sensing out-of-ink/ink-low conditions and also to help establish and continue the operation of the backpressure device 16. The fluid sensors 34 may take the form of any suitable means, such as resistive, capacitive or optical components. Since these components are well-known, it is not necessary to illustrate them nor describe them in detail. The fluid sensors 34 are used to indicate "out-of-ink" or "ink-low" conditions. Also, the fluid sensors 34 together with the air removal device 18 enable easier initial establishment of the fluid and air levels in the first and second chambers 24, 26 of the backpressure device 16 to create the additional backpressure in the system 10 as provided by the backpressure device 16. The fluid sensors 34 also make it easier to re-establish fluid and air levels once the fluid supply tank 14 is out of fluid. (Other fluid sensors 126 provided in a separate portion 131 of the first chamber 24 of the device 16 for sensing the level of fluid in the supply tank 14 will be described later in relation to the exemplary embodiment of FIGS. 15-19.)

The operation of the backpressure device 16 during an initial filling operation is shown in FIGS. 3A through 3D. Initially, to start the fluid filling operation as seen in FIG. 3A, the valve 30 is closed and the air removal device 18 is turned "on" so as to cause gradual removal of air from within the second chamber 26 creating a vacuum condition throughout the second chamber 26. This vacuum condition communicates through the upper outlet 24C between the second chamber 26 and first chamber 24 to draw a column of fluid upward in the upright passageway 24D of the first chamber 24 from the fluid supply tank 14 until the column of fluid reaches the level of the upper outlet 24C which is also the inlet to a fluid drop entry portion 26C in the chamber 26. This fluid drop entry portion 26C is created by one interior wall 22 being in the form of a partition extending from the top of the container 20 at which level the fluid from the advancing column pours or spills through the upper outlet 24C into the fluid drop entry portion 26C. A column of air present in the fluid drop entry portion 26C is what supplies the additional or increased backpressure of the backpressure device 16.

The fluid falls or descends downward to lower portion 26A of the second chamber 26. The lower portion 26A is separated from the upper portion 26B by another interior wall 22 in the form of another partition defining an opening 26D between the lower and upper portions 26A, 26B of the second chamber 26, as seen in FIG. 3A. This is where the fluid that flowed initially into the fluid drop entry portion 26C now accumulates to supply the printhead 12 via the second conduit 28. Also, as long as the air removal device 18 remains turned "on", the level of fluid in the lower portion 26A of the second chamber 26 will rise in the upper portion 26B of the second chamber 26 but not in the fluid drop entry portion 26C thereof, as seen in FIG. 3B.

The filling operation will continue, as seen in FIG. 3B, by continuing the removal of air from the upper portion 26B of the second chamber 26 by operation of the air removal device 18, until reaching the point where the fluid sensors 34 are covered. The option then arises that fluid filling from the fluid supply tank 14 via the air removal device 18 can be terminated or allowed to continue longer, as seen in FIG. 3C. This point occurs when the air-fluid interface 32 rising from the lower portion 26A upwardly in the second chamber 26 passes above the fluid sensors 34 to just below the air removal device 18, as seen in FIG. 3C.

If the filling operation is allowed to continue more, as in FIG. 3C, then raising the air-fluid interface 32 will cease by stopping removal of air through operation of the air removal device 18 when the level reaches above or covers the air removal device 18, as seen in FIG. 3D. At this point fluid will begin to be removed with the air. This represents the "totally filled" condition where all air and/or fluid removal is completed, whereby the maximum upper limit is reached by the rising air-fluid interface 32. The "totally filled" condition is the total fluid holding capacity of the container 20 that will be maintained and supply fluid to the printhead 12 until an out-of-fluid condition of the fluid supply tank 14 is reached, such as seen in FIG. 4. As long as fluid remains in the fluid supply tank 14, the operation of the printhead 12 will not start to reduce the "totally filled" condition of the second chamber 26 of the backpressure device 16.

Sensing of an out-of-fluid or fluid-low condition occurs, as seen in FIG. 4, when air bubbles enter the first chamber 24 from the empty fluid supply tank 14 and rise up through the upright passageway 24D of the first chamber 24 and flow through the upper outlet 24C to the second chamber 26. When the fluid level between the lower portion 26A and fluid drop entry portion 26C of the second chamber 26 decreases air bubbles may also rise into the upper portion 26B of the second chamber 26 causing fluid from the upper portion 26B to raise the fluid level between portions 26A, 26C until air is no longer adjacent to the opening of the upper portion 26B. The decreasing level of the air-fluid interface 32 in the upper portion 26B of the second chamber 26 restores the backpressure in the fluid drop entry portion 26C of the second chamber 26. Use of the fluid by the printhead 12 will reduce the level of the air-fluid interface 32 in the upper portion 26B of the second chamber 26, and uncover the sensors 34 indicating the remaining status of the fluid to an operator. Eventually enough air will be introduced into the upper portion 26B of the second chamber 26 to indicate an out-of-ink condition has been reached Turning now to the diagrams (a)-(c) in FIGS. 6 and 7, there are shown other exemplary embodiments of the backpressure device 16 of the system I 0. FIG. 5 is a key depicting the symbols used in the diagrams (a)-(c) of FIGS. 6 and 7 (and in FIGS. 1-4 as well). The In/Out symbol corresponds to the inlet from the fluid supply tank 14 and the outlet toward the printhead 12 As seen in FIG. 6, the backpressure device 16 may have dual air removal devices 18. Each of the air removal devices 18 is located in one of the first and second chambers 24, 26 to make sure that there is a consistent fluid flow without bubbles flowing out of the respective chamber 24, 26. The first chamber 24 may also contain fluid sensors 34, which may be used for both initial fluid filling and tank replacement conditions as seen in FIGS. 3A-3D. The additional air removal device 18 is disposed in communication with the first chamber 24 of the backpressure device 16 below an air-fluid interface 35 therein and upstream from an inlet 24E to the upright passageway 24D of the first chamber 24 and is operable to enable periodically removing some air from the upper portion 241B of the first chamber 24 to maintain either one of additional backpressure or reserve ink therein.

In FIG. 6, the diagram (a) has the first arrangement and diagrams (b) and (c) have the second arrangement, as described previously above. The diagram (c) also has a slight change that allows for a secondary pressure drop in the first chamber 24. In all three diagrams in FIG. 6, the fluid sensing by multiple sensors 34 is done in the first chamber 24. The second chamber 26 usually does not see the bubbles from the out-of-fluid condition. The second chamber 26 is only to help establish a fluid supply reservoir 12B to the printhead 12 without introducing bubbles and to increase the system backpressure.

As seen in diagrams (a)-(c) of FIG. 7, the backpressure device 16 may have a single air removal device 18. With only a single air removal device 18 present, when air is to be removed the air initially creates a column of fluid which then drops down the second chamber 26 until the air-fluid interface 32 at a desired level is reached This creates the extra backpressure In all three diagrams in FIG. 7, the air removal device 18 is located in the second chamber 26 In diagrams (6) and (c) in FIG. 7, another portion 26D is provided in the second chamber 26 that contains the air removal device 18. In all three diagrams in FIG. 7, the fluid sensors 34 are located in the second chamber 26. In diagram (6) in FIG. 7, the fluid sensors 34 located in the other portion 26D of the second chamber 26.

Turning now to FIGS. 8-14, there is illustrated an exemplary embodiment of one advantageous construction of a backpressure device 36 with air removal and fluid level sensing positions which, due to various design and manufacturing considerations, uses the diagram (b) in FIG. 7 as its guide in reconfiguration and integration of device into a single unit. The backpressure device 36 includes a device body 38 and a single closure 40. The device body 38 and closure 40 are assembled together to construct at least one and preferably a plurality of towers 20 positioned side-by-side one another and each having a set of first and second chambers 24, 26, as described earlier. The plurality of side-by-side positioned towers 20 are preferably four in number or one for each of the four colors typically used in printing—black (or mono), yellow, cyan and magenta, as seen best in FIGS. 9, 10, and 11.

More particularly, the device body 38 is in the form of a plate of substantially flat or planar configuration. The device body 38 provides one of two opposite end walls 36A of the device 36 which also define one of the opposite end walls for the towers 20. The closure 40, which may be in the form of a sheet of film or a plate of substantially flat or planar configuration, provides the other of the two opposite end walls 36B of the device 36 which also define the other of the opposite ends walls for the towers 20. Thus, the two end walls 36A, 36B of the device 36 are substantially flat or planar, face toward each other, and extend substantially parallel to one another.

The device body 38 may be made of a suitable plastic, such as polypropylene, which facilitates the use of relatively simple heated tools to form structural elements thereon which will be described hereinafter. The closure 40 may be made of multilayered films with one of the layers being polypropylene to effect sealing to, and thus a reliable leak-proof assembly with, the device body 38. The films can be replaced with thicker materials and the heat sealing can be replaced with laser or ultrasonic welding to create a leak-proof assembly.

Different structural elements, as will now be described, are formed on opposite sides of the device body 38 to perform different functions or serve different purposes. For instance, first structural elements in the form of continuous exterior edge walls 42 are formed on and protrude outwardly from one of the opposite sides 38A of the device body 38. The exterior edge walls 42 are located between and interconnect the device body 38 and closure 40 so as to define the perimeters of the towers 20, as seen in FIGS. 9 and 10. Some of the exterior edge walls 42 are shared by adjacent ones of the towers 20.

Second structural elements in the form of interior partition walls 44 encompassed by the continuous exterior edge walls 42 are formed also on the one side 38A of, and protrude outwardly from, the device body 38. The interior partition walls 44 are located between the device body 38 and closure 40 so as to define the first and second chambers 24, 26, within the perimeters of the towers 20. The closure 40 is fixedly attached to outer surfaces 42A, 44A on the exterior edge walls 42 and the interior partition walls 44 so as to enclose the first and second chambers 24, 26, of the towers 20.

Given segments of the exterior edge walls 42 and interior partition walls 44 are either closely or remotely spaced so as to correspondingly form flow retarding or flow enabling elements in the respective first and second chambers 24, 26 of the towers 20. The given segments of the walls 42, 44 that are wide or remotely spaced from each other and thus define flow enabling elements are used to allow fluid and air to pass each other. The given segments of the walls 42, 44 that are narrow or closely spaced from each other form passageways 46 that provide flow retarding elements to move fluid and air together. Selected segments of the interior partition walls 44 have narrow transition features in the form of notches 44B formed therein, as seen in FIG. 9, between the fluid and air sections of the chambers 24, 26 to prevent fluid and air from easily exchanging positions while moving the backpressure device 36.

When space constraints do not allow for sufficiently wide cross sections (wide features) at the passageways 46 to allow air to bubble through standing fluid, then third structural elements in the form of elongated protrusions (for example, ribs, grooves and the like) 48 are used to guarantee a fluid path while a bubble is trying to float to the top of the fluid in the first chamber 24 or second chamber 26, as seen in FIG. 10. The elongated protrusions 48 are formed thereon between the adjacent segments of the continuous exterior edge wall 42 and the interior partition walls 44 and through at least one of the flow retarding passageways 46 so as to define a path to enable fluid and air flow between the adjacent segments and through the passageway 46.

Fluid flow is permitted respectively into and from the first and second chamber 24, 26, of the towers 20 by fourth structural elements in the form of inlets 50 and outlets 52. They are formed throughout the device body 38 and between the opposite sides 38A, 38B thereof, as seen in FIG. 10. Fifth structural elements in the form of nipples 54, 55 are formed on the opposite side 38B of the device body 38 for attachment of the first and second conduits 27, 28 thereto in order to communicate with the inlets 50 and outlets 52. Sixth structural elements in the form of ports 56 are formed throughout the device body 38 and between the opposite sides 3 8A, 3 8B for attachment of a suitable air removal device (not shown), such as a vacuum system for pulling air through hydrophobic membranes 67 covering these ports 56, as described below. These ports 56 may be encircled or bounded by seventh structural elements in the form of rims 58, 60 attached on the opposite sides 38A, 38B, as seen in FIGS. 10 and 11. Eighth structural elements in the form of apertures 60 also are formed throughout the device body 38 and between the opposite sides 38A,38B thereof for the attachment of fluid sensors 34 to the first and second chambers 24, 26 of the towers 20, as seen in FIGS. 8 and 9.

Additional backpressure in the second chambers 26 of the towers 20 is established by ninth structural elements in the form of drip ports 63 and fluid entrance ports 64 both of which are formed throughout the device body 38, respectively in second and first chambers 26, 24 of the towers 20 with portions of the interior partition wall 44 therebetween, and between the opposite sides 38A, 38B of the device body 38, as seen in FIGS. 9, 10 and 13. Tenth structural elements in the form of by-pass channels 66 for interconnecting the drip ports 63 and fluid entrances 64 to allow fluid to pass through entrances 64 and reach the drip ports 63 are formed throughout the device body 38 on the side 38B, as seen in FIGS. 8, 11 and 12. The by-pass channels 66, in effect, permit fluid to pass from the entrances 64 to the drip ports 63, bypassing the portions of the partition walls 44 on the opposite side 38A of the device body 38. Hydrophobic membranes 67, as shown in FIGS. 8 and 9, are provided to cover the ports 56 by sealing the membranes 67 on the rims 58 on the side 38A, as seen in FIG.10 The membranes 67 allow air to pass, but not fluid (ink). The vent film 68 (which is like film 40 used on the side 38A as described above) is heat sealed to the rims 60, 66 on the opposite side 38B of the device body 38 to respectively form a common air removal chamber 70 for all of the color towers and also close the by-pass channels 66. The closure 40 and the device body 38 are both melted and when cooled and have a strong chemical bond. The closure 40 is also heat sealed in the same manner to the device body 38 to complete the other end wall 36B of the backpressure device 36.

Implementing the backpressure device 36 into a single unit allows the device 36 to share some functions, specifically venting components and therefore minimize cost. Further, providing the backpressure device 36 as a single unit allows the use of the multiple hydrophobic membranes 67 and the common air removal chamber 70. The hydrophobic membranes 67 allow air and not fluid, such as ink, to be pulled out of the device 36. With using hydrophobic membranes, the pressure is limited and a common valve must be used to prevent air from coming back through the membranes. An alternative design approach is to use multiple individual air/fluid removal positions with multiple valves instead of multiple hydrophobic membranes and the common valve.

Referring to FIG. 14, an option to use instead of the fluid sensors 34, as seen in FIGS. 8 and 9, is an optical ink sensor in the form of an optical prism 72. The optical prism 72 works satisfactorily especially in a vertical configuration. Light is emitted and received perpendicular to the optical prism 72. Additionally, an external saw tooth design with flat interior surface will also work well due to the vertical orientation. An emitted light and receiving sensor (not shown) would be at an angle to the device body 38. Contact, optical, or other non-contact methods may all be used to sense the presence of fluid in the backpressure device 36. The fluid level information may then be used to work with out-of-ink fluid tanks and machine maintenance or priming operations. Signals on many of the fluid sense methods can be shared.

Turning now to FIGS. 15-19, there is illustrated an exemplary embodiment of another advantageous construction of a fluid height backpressure device 74 with air removal and fluid level sensing positions. The backpressure device 74 includes a device body 76 and a pair of (front and rear) closures 78, 80, each on one of the front and rear sides 76A, 76B of the device body 76. The device body 76 and front and rear closures 78, 80 are assembled together to construct at least one and preferably a plurality of towers 20 positioned side-by-side one another and each having first and second chambers 24, 26, as described earlier, now with portions on both front and rear sides 76A, 76B of the device body 76. Unlike the earlier device body 38 of FIGS. 8-13, wherein ink and air were present in the first and second chambers 24, 26 of the towers 20 which were only on the one side 38A (except for presence of ink in by-pass channels 66 and air in common air removal chamber 70 on the opposite side 38B) of the device body 38, in the device body 76 of FIGS. 15-19 ink and air are present in the first and second chambers 24, 26 of the towers 20 on both sides 76A, 76B of the device body 76. The plurality of side-by-side positioned towers 20 are preferably four in number or one for each of the four colors typically used in printing—black (or mono), yellow, cyan and magenta, as seen best in FIGS. 9, 10, and 11.

More particularly, the device body 76 is in the form of a plate of substantially flat or planar configuration. The device body 76 provides an intermediate wall 74A of the device 74 which also defines the intermediate wall for the towers 20. The front and rear closures 78, 80, which each may be in the form of a sheet of film or a plate of substantially flat or planar configuration, provide the opposite end walls 74B, 74C of the device 74 which also define the opposite end walls for the towers 20. Thus, the end walls 74B, 74C of the towers 20 are also substantially flat or planar, face toward each other with the intermediate wall 74A of the device body 76 between them, and all three extending substantially parallel to one another.

The device body 76, like the device body 38, may be made of a suitable plastic, such as polypropylene, which facilitates the use of relatively simple heated tools to form the structural elements thereon. The closures 78, 80, like the closure 40, may be made of multilayered films with one of the layers being polypropylene to effect sealing to, and thus a reliable leak-proof assembly with, the device body 76. The films can be replaced with thicker materials and the heat sealing can be replaced with laser or ultrasonic welding to create a leak-proof assembly.

The different structural elements, comparable to the ones described above on the device body 38, are formed on the opposite front and rear sides 76A, 76B of the device body 76 to perform different functions or serve different purposes. For instance, first structural elements in the form of continuous exterior edge walls 82, 84 are formed on and protrude outwardly from the opposite front and rear sides 76A, 76B of the device body 76. The exterior edge walls 82, 84 are located between and interconnect the device body 76 and front and rear closures 78, 80 so as to define the perimeters of the towers 20, as seen in FIGS. 16 and 17. Some of the exterior edge walls 82, 84 are shared by adjacent ones of the towers 20.

Second structural elements in the form of interior partition walls 86, 88 encompassed by the continuous exterior edge walls 82, 84 are formed also on the front and rear side 76A, 76B of, and protrude outwardly from, the device body 76. The interior partition walls 86 on the front side 76A are located between the device body 76 and front closure 78 and the interior partition walls 88 on the rear side 76B are located between the device body 76 and the rear closure 80 so as to define portions of the first and second chambers 24, 26, within the perimeters of the towers 20 on the front and rear sides 76A, 76B of the device body 76. The closure 78 is fixedly attached to outer surfaces 82A, 86A on the exterior edge walls 82 and interior partition walls 86 so as to enclose the respective portions of the first and second chambers 24, 26, of the towers 20 on the front side 76A of the device body 76. The closure 80 is fixedly attached to outer surfaces 84A, 88A on the exterior edge walls 84 and interior partition walls 88 so as to enclose the respective portions of the first and second chambers 24, 26 of the towers 20 on the rear side 76B of the device body 76. The closures 78, 80 and the device body 76 are heat sealed together to have a strong chemical bond and completed the enclosed towers 20 of the backpressure device 74.

Given segments of the exterior edge walls 82, 84 and interior partition walls 86, 88 are either closely or remotely spaced so as to correspondingly form flow retarding or flow enabling elements in the respective first and second chambers 24, 26 of the towers 20. The given segments of the walls 82, 84 and 86, 88 that are wide or remotely spaced from each other and thus define flow enabling elements are used to allow fluid and air to pass each other. Passageways 90 that are narrow or closely spaced from each other and thus define flow retarding elements are used to move fluid and air together. Selected segments of the interior partition walls 88 on the rear side 76B of the device body 76 have narrow transition features in the form of notches 88B formed therein, as seen in FIG. 17, between the fluid and air sections of the chambers 24, 26 to prevent fluid and air from easily exchanging positions while moving the backpressure device 74.

When space constraints do not allow for sufficiently wide cross sections (wide features) at the passageways 90 to allow air to bubble through standing fluid, then third structural elements in the form of elongated protrusions (for example, ribs, grooves or the like) 92 are used to guarantee a fluid path while a bubble is trying to float to the top of the fluid in the first chamber 24 or second chamber 26, as seen in FIG. 16. The elongated protrusions 92 are formed thereon between and along the adjacent closely spaced segments of the continuous exterior edge wall 82 and the interior partition walls 86 so as to prevent forming flow retarding passageways and instead define a path to enable fluid and air flow between the adjacent segments, Fluid flow is permitted respectively into and from the first and second chamber 24, 26, of the towers 20 by fourth structural elements in the form of inlets 94 and outlets 96. They are formed throughout the device body 76 and between the opposite front and rear sides 76A, 76B thereof, as seen in FIG. 17. Fifth structural elements in the form of nipples 98, 100 are formed on the front side 76A of the device body 76 aligned with the inlets 94 and 96 for attachment of the first and second conduits 27, 28 thereto in order to communicate with the inlets 94 and outlets 96.

Sixth structural elements in the form of air removal ports 102 and ink level sense vent ports 104 are formed throughout the device body 76 and between the opposite sides 76A, 76B. The air removal ports 102 are connected by second chambers 26, via holes 107 therein defined through the device body 76 near the upper ends of the second chambers 26, to a common channel 106 running horizontally across the upper portion of the device body 76 along the front side 76A thereof The common channel 106 in turn communicates with a common air removal/ink priming outlet port 108 which may be connected to a suitable air removal device (not shown). The ink level sense vent ports 104 are connected by first chambers 24 to a common channel 110 running horizontally across the lower portion of the device body 76 along the rear side 76B thereof. The common channel 110 in turn communicates with a common ink level sense air vent outlet port 112. Seventh structural elements in the form of hydrophobic membranes 114, 116, as shown in FIG. 15, are provided to cover the ports 102, 104 by sealing the membranes 114, 116 on rims 118, 120 on the side 76A, as seen in FIGS. 15 and 16. The membranes 114, 116 allow air to pass, but not fluid (ink). If the device 74 is inadvertently tilted, the hydrophobic membranes 1I 6 prevent fluid (ink) from spilling out of the device 74 from the first chambers 24 of the towers 20.

Eighth structural elements in the form of apertures 122 are formed throughout the device body 76 extending between the opposite sides 76A, 76B thereof, as seen in FIGS. 16 and 18. The apertures 122 are aligned with bosses 124 formed on the rear side 76B of the device body 76, as seen in FIGS. 17 and 19, for receipt and attachment of fluid sensors 126, in the form of pins as shown in FIG. 15, in communication with fluid in the separate column portion 131 of the first chamber 24 of the towers 20 and also with fluid in chamber 26. Firmware/electronics of the printer (not shown) connected via an electrical circuit 134 to the sensors 126 will read the sensors 126 (periodically) as required. (It should be readily understood that the electrical circuit 134 is actually disposed outside of the rear closure 80 shown in FIG. 15 but not shown in FIG. 19.) As diagrammatically depicted in FIGS. 3A-3D and 4, the backpressure device 16 and the fluid supply tank 14 are both vented to the atmosphere and positioned relative to one another such that the fluid sensors 126 (126A-126C in FIG. 15) align with different levels of fluid in the supply tank 14, such as ¾, ½ and ¼. In FIG. 18, an exemplary embodiment of a first portion 134A of the electrical circuit 134 is shown that provides an indication of the different fluid levels, such as ¾, ½ and ¼, as sensed by one of the fluid sensors 126A, 126B and 126C in the column portion 131 of the first chamber 24 of the backpressure device 74. A second portion 134B of the electrical circuit 134 provides an indication of an out-of-ink condition as sensed by fluid sensors 126E in the second chamber 26 of the backpressure device 74. A full level in the tank 14 is not sensed; instead a new tank 14 is assumed to be full. The column portion 13 of the first chamber 24 is vented to atmosphere through the hydrophobic membranes 116 on the rims 120 surrounding the ink level sense vent ports 104. With the fluid supply tank also vented, the height of the fluid level in the column portion 131 of the first chamber 24 of the device 16 (corresponding to device 74 in FIG. 18) equalizes with the height of the fluid inside the fluid supply tank 14, as best depicted in FIGS. 3A-3D.

Thus, the purpose of the fluid sensors 126A-126C on the backpressure device 74 is to provide an accurate representation of the ink (or other fluid) levels remaining in the supply tank 14 to the user. Fluid sensor 126D, the fourth sensor pin, is used to complete the first and second portions 134A, 134B of the electrical circuit 134. The fourth sensor 126D stays submersed in ink at all times after the supply tank 14 is installed. However, it could easily be adapted to include more or less levels. Also, as seen in FIGS. 16-19, the ink level path which extends to vent outlet port 112 is broken up into two parts: a fluid side on the front side 76A of the device body 76 and an air side on the rear side 76B of the device body 76. The fluid and air sides are separated by the technical vent ports 104 covered by hydrophobic membranes 116 that prevent ink from leaking out of the device 74 if oriented improperly. Also a valve (not seen) may be connected to outlet port 112 at the end of the ink level path to help prevent inaccurate readings. When the tank 14 is inserted with the backpressure device 74 and this valve is opened, atmospheric pressure equalizes the fluid level in the tank 14 and the fluid level in the ink level sense fluid column portion 131 of the device body 76. The entire area of the column portion 131 is not filled up; instead it holds a vertical level of ink equal to that in the ink supply tank 14 (since both the tank 14 and column portion 131 are vented to atmosphere). The level of the ink in the column portion 131 completes (closes) the first portion 134A of the electrical circuit 134 with one or all of the pins making up the fluid sensors 126A-126C, depending upon the actual ink level in the supply tank(s) 14. As ink is used up, the level drops in the supply tank 14 and in the column portion 131 and breaks (opens) the first electrical circuit portion 134A between one or more of the fluid sensors (pins) 126A-126C, indicating what the current ink level is. However, the ink level would be falsely represented if the friction loss (resistance) between in the ink level sense column portion 131 and the main ink path through the main portion 133 of the first chamber 24 is sufficiently different than the friction loss between the inserted supply tank 14 and the main ink path Such condition would cause ink to be drawn from the ink level sense column portion 131 at a faster rate than from the supply tank 14 or vice versa. To prevent this condition, the valve connected to the vent port 112 can be closed during ink usage (printing, priming, purging, etc.). Once the system is sitting at idle, the valve is opened and the first portion 134A of the electrical circuit 134 provides an accurate representation of ink level.

Either one of additional backpressure or reserve ink in the second chambers 26 of the towers 20 is established by ninth structural elements in the form of drip ports 128 formed through the device body 76, as seen in FIGS. 16-19, providing communication between the first and second chambers 24 and 26 of the towers 20 on the opposite sides 76A, 76B of the device body 76. Arrows in FIGS. 18 and 19 show the paths of fluid flow in one of the towers 20 which would be the same in the other three towers 20. The fluid from the inlet 94 on the back side 76B of the device body 76 flows to the front side 76A thereof via a through-hole 130 into the first chamber 24 where the flow then splits into two directions: one, upward through the first chamber 24 to the drip port 128; and, two, downward and then upward through a separate ink level sense column portion 131 of the first chamber 24 (see also FIGS. 3A-3D and 4) where the fluid flow is terminated by the height of the ink in the fluid supply tank, as further limited by the presence of the hydrophobic membranes 116 while air is vented through vent ports 104 and vent outlet port 112. The fluid flow upward through the first chamber 24 on the font side 76A to the drip port 128 enters the second chamber 26 on the rear side 76B and drips downward to a large opening 132 formed through the device body 76, as seen in FIGS. 16-19, where the flow then splits into two directions: one, downward and then upward through the exit portion of the second chamber 26 to the fluid outlet 96; and, two, upward through the priming portion of the second chamber 26 where the fluid flow is terminated by the presence of the hydrophobic membranes 114.

The foregoing description of several embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. A fluid height backpressure device, comprising:

a device body of substantially planar configuration and having opposite sides;

a pair of closures of substantially planar configuration, each closure positioned on one of the opposite sides of the device body, the closures and device body assembled into at least one tower as a single unit of a substantially planar configuration and having a perimeter and first and second chambers within the perimeter, the device body providing an intermediate wall of the tower, the closures providing opposite end walls of the tower facing toward each other;

continuous exterior edge walls formed on and protruding outwardly from the opposite sides of the device body and located between the device body and closures so as to define the perimeter of the tower;

interior partition walls encompassed by the continuous exterior edge walls, formed on and protruding outwardly from the opposite sides of the device body, and located between the device body and closures so as to define the first and second chambers within the perimeter of the tower, the closures being fixedly attached to outer surfaces on the continuous exterior edge walls and the interior partition walls so as to enclose the first and second chambers of the tower;

an inlet formed through the device body to permit flow of fluid into the first chamber;

an outlet formed through the device body to permit flow of fluid from the second chamber; and a fluid drip port between the first and second chambers for establishing backpressure in the second chamber of the tower, the fluid drip port being at a top of the first chamber above an air-fluid interface in the second chamber so fluid can drip downward from the fluid drip port through air before reaching the air-fluid interface.

2. The device of claim 1 wherein the continuous exterior edge walls and the interior partition walls have adjacent segments spaced from each other in at least one of the first and second chambers of the tower.

3. The device of claim 2 wherein the device body has at least one elongated protrusion formed thereon between and along the adjacent closely spaced segments of the continuous exterior edge walls and the interior partition walls so as to prevent forming flow retarding passageways and instead define a path enabling fluid and air flow between the adjacent segments.

4. The device of claim 1 wherein the device body has a port formed therethrough and between the opposite sides thereof for the attachment of an air removal device to the device body.

5. The body of claim 1 wherein the device body has at least one aperture formed therethrough and between the opposite sides thereof for attachment of at least one liquid level sensor to at least one of the first and second chambers of the tower.

6. The device of claim 1 wherein the device body has attachment nipples formed on the opposite side of the device body from the inlet and outlet for the attachment of conduits to communicate with the inlet and outlet.

7. The device of claim 1 wherein the device body has hydrophobic membranes covering one or more ports in the first and second chambers for at least one of removal and venting of air from fluid therein and preventing spillage of fluid upon tipping of said device.

8. The device of claim 1 wherein the continuous exterior edge walls and the interior partition walls have adjacent segments spaced remotely from each other so as to form flow enabling areas in at least one of the first and second chambers of the tower.

9. A fluid height backpressure device, comprising:

a device body of substantially planar configuration and having opposite sides;

a pair of closures of substantially planar configuration, each closure positioned on one of the opposite sides of the device body, the closures and device body assembled into a plurality of towers as a single unit of a substantially planar configuration and having a perimeter and first and second chambers within the perimeter, the device body providing an intermediate wall of the towers, the closures providing opposite end walls of the towers facing toward each other;

continuous exterior edge walls formed on and protruding outwardly from the opposite sides of the device body and located between the device body and closures so as to define the perimeter of the towers;

interior partition walls encompassed by the continuous exterior edge walls, formed on and protruding outwardly from the opposite sides of the device body, and located between the device body and closures so as to define the first and second chambers within the perimeter of the towers, the closure being fixedly attached to outer surfaces on the continuous exterior edge walls and the interior partition walls so as to enclose the first and second chambers of the towers;

inlets formed through the device body to permit flow of fluid into the first chambers of the towers;

outlets formed through the device body to permit flow of fluid from the second chambers of the towers; and a fluid drip port between the first and second chambers of each of the towers for establishing backpressure in the second chamber of each of the towers, the fluid drip port in said each of the towers being at a top of each of the first chambers above an air-fluid interface in the second chambers so fluid can drip downward from the fluid drip ports through air before reaching the air-fluid interface.

10. The device of claim 9 wherein the sets of first and second chambers of the towers are non-communicative with one another for adapting each tower to hold a different color ink fluid.

11. The device of claim 9 wherein the device body and closures are made of materials deformable and sealable by application of heat thereto.

12. The device of claim 9 wherein the continuous exterior edge walls and the interior partition walls have adjacent segments spaced from each other so in at least one of the first and second chambers of each of the towers.

13. The device of claim 12 wherein the device body has at least one elongated protrusion formed thereon between and along the adjacent closely spaced segments of the continuous exterior edge walls and the interior partition walls and so as to prevent forming flow retarding passageways and instead define a path enabling fluid and air flow between the adjacent closely spaced segments.

14. The device of claim 9 wherein the device body has a port formed therethrough and between the opposite sides thereof for the attachment of an air removal device to the device body.

15. The device of claim 9 wherein the device body has at least one aperture formed therethrough and between the opposite sides thereof for attachment of at least one liquid level sensor to at least one of the first and second chambers of each of the towers.

16. The device of claim 9 wherein the device body has attachment nipples formed on the opposite side of the device body from the inlets and outlets for the attachment of conduits to communicate with the inlets and outlets.

17. The device of claim 9 wherein the device body has hydrophobic membranes covering one or more ports in the first and second chambers for at least one of removal and venting of air from fluid therein by-pass channels formed on the opposite side of the device body and preventing spillage of fluid upon tipping of said device.

18. The device of claim 9 wherein the continuous exterior edge walls and the interior partition walls have adjacent segments spaced remotely from each other so as to form flow enabling areas in at least one of the first and second chambers of each of the towers.

19. A fluid height backpressure system for supplying fluid from a fluid supply tank to a printhead, comprising:

a backpressure device disposed in an upright position and including a tower having a plurality of walls spaced apart from one another so as to define first and second chambers, said second chamber containing fluid and air making contact with the fluid at an air-fluid interface such that an air gap is created in said second chamber between said first chamber and said air-fluid interface in said second chamber, said first and second chambers connected in flow communication with each other by a drip port of said first chamber that opens into said second chamber such that fluid can flow downward from said drip port through said air gap to the fluid in said second chamber;

an inlet on said first chamber of said backpressure device for coupling with a fluid supply tank vented to external atmosphere for enabling flow of fluid from the fluid supply tank to said first chamber of said backpressure device;

an outlet on said second chamber of said backpressure device for coupling with a printhead for enabling flow of fluid from said second chamber of said backpressure device to the printhead;

an upright passageway defined in said first chamber in communication with said inlet for receiving fluid from the fluid supply tank, said upright passageway also in communication with said air gap of said second chamber such that fluid from said upright passageway communicates through said drip port of said first chamber and drops downward through said air gap of said second chamber to reach the fluid therein;

an upright column portion defined in said first chamber separate from said upright passageway and in communication with said inlet for receiving fluid from the fluid supply tank, said upright column portion being vented to the exterior atmosphere at a location above an upper level of the fluid therein so as to be isolated from said upright passageway while permitting the upper level of the fluid to equalize height with an upper level of fluid in the fluid supply tank;

and at least one fluid sensor on said backpressure device being connected with said upright column portion of said first chamber thereof to enable providing an indication of the level of the fluid in said upright column portion relative to said at least one fluid sensor and thereby providing a corresponding indication of the level of the fluid in the fluid supply tank.

20. The system of claim 19 wherein said at least one fluid sensor includes a plurality of said fluid sensors providing a corresponding plurality of indications of different levels of fluid in the fluid supply tank and connected to an electrical circuit for reading said fluid sensors.

* * * * *